US005213589A

United States Patent [19]

Ronning et al.

[11] Patent Number: 5,213,589

[45] Date of Patent: May 25, 1993

[54] ABRASIVE ARTICLES INCLUDING A CROSSLINKED SILOXANE, AND METHODS OF MAKING AND USING SAME

[75] Inventors: Albert J. Ronning, North Oaks; Charles M. Leir, Falcon Heights, both of Minn.

[73] Assignee: Minnesota Mining and Manufacturing Company, St. Paul, Minn.

[21] Appl. No.: 832,474

[22] Filed: Feb. 7, 1992

[51] Int. Cl.[5] ..... B24D 3/00

[52] U.S. Cl. ..... 51/293; 51/295; 51/298; 51/308; 528/43

[58] Field of Search ..... 51/293, 295, 298, 308; 528/43; 556/450

[56] References Cited

U.S. PATENT DOCUMENTS

| | | | |
|---|---|---|---|
| 3,699,727 | 10/1972 | McDonald | 51/295 |
| 3,957,461 | 5/1976 | Lindstrom etal | 51/295 |
| 4,154,714 | 5/1979 | Hockemeyer et al. | 528/43 |
| 4,208,504 | 6/1980 | Hockemeyer et al. | 528/43 |
| 4,211,729 | 7/1980 | Marquardt et al. | 528/43 |
| 4,776,861 | 10/1988 | Frushour | 51/293 |
| 4,828,582 | 5/1989 | Frushour | 51/293 |
| 4,836,832 | 6/1989 | Tumey et al. | 51/293 |
| 4,909,935 | 3/1990 | Bradshaw et al. | 528/43 |

*Primary Examiner*—William R. Dixon, Jr.
*Assistant Examiner*—Willie J. Thompson
*Attorney, Agent, or Firm*—Gary L. Griswold; Walter N. Kirn; Jeffrey L. Wendt

[57] ABSTRACT

An abrasive article is provided, the article including a substrate having an abrasive surface thereon including particles of an abrasive material secured by a binding medium wherein at least a portion of the abrasive surface has thereon a coating including a crosslinked siloxane. Methods of making and using such an articles are also presented.

27 Claims, 4 Drawing Sheets

ABRASIVE ARTICLES INCLUDING A CROSSLINKED SILOXANE, AND METHODS OF MAKING AND USING SAME

CROSS-REFERENCE TO RELATED APPLICATIONS

The application is related to assignee's co-pending application Ser. No. 07/832,270 filed Feb. 7, 1992, entitled Moisture Cureable Polysiloxane Release Coating Compositions.

FIELD OF THE INVENTION

This invention pertains to abrasive articles including a crosslinked siloxane coating over at least a portion of the abrasive surface. Optionally, on the reverse side or back side of the abrasive article is a pressure sensitive adhesive coating. It has been determined that the presence of the crosslinked siloxane on the abrasive surface reduces loading, and, where a pressure sensitive adhesive is used, reduces transfer of the pressure sensitive adhesive to the abrasive side of the abrasive article when the abrasive article is packaged. The crosslinked siloxane also reduces the peel force required to separate one pressure sensitive adhesive-backed abrasive sheet from another, such as when a continuous roll of pressure sensitive adhesive-backed coated abrasive discs is unwound.

BACKGROUND ART

Abrasive articles typically comprise a substrate or backing having on a surface thereof a plurality of abrasive particles secured thereto by a binding medium. In some instances coated abrasives include a backing, a first coating layer bonded to one side of the backing (commonly referred to as a make coating), at least one layer of abrasive particles bonded to the backing using the first coating layer, and a second coating layer overlaying the abrasive particles, which is commonly referred to as a size coating. The purpose of the size coating is to reinforce retention of the abrasive particles. Another type of coated abrasive construction includes a backing having an abrasive composite bonded to one side of a backing. The abrasive composite includes a plurality of abrasive particles dispersed throughout a binding medium. Typically, the abrasive composite is formed from an abrasive slurry.

Coated abrasive articles can be converted into a wide variety of different forms such as belts, discs, cones and sheets. It is sometimes preferable to have a pressure sensitive adhesive (PSA) coating on at least a portion of the non-abrasive side of the coated abrasive. The coated abrasive, for example, a disc, can then be secured to a support pad and when the abrasive disc is to be replaced, it can be removed and a new abrasive disc secured to the same support pad.

A common way to package a plurality of coated abrasive discs each having a PSA backing is illustrated in U.S. Pat. No. 3,849,949 (Steinhauser et al.). Steinhauser discloses an abrasive disc product comprising a convolutely wound concatenation of coated abrasive discs having disposed on the side opposite the coated abrasive a PSA with the adhesive coating placed in releasable contact with the abrasive coating. Unfortunately, while these constructions are adequate for most purposes, this direct contact between the abrasive coating and PSA can facilitate transfer of the PSA to the abrasive coating, especially in the finer abrasive particle grades of coated abrasives. Consequently, this transfer may cause contamination of the workpiece and the abrasive coating, and may reduce the adhesive nature of the PSA coating, which may present a safety concern. In addition, the force required to unwind the continuous roll of Steinhauser, while not prohibitive, may be an inconvenience for the user. This is compounded by the propensity of many PSA's to increase in adhesion with dwell time on a surface, translating into even higher unwind force.

The PSA transfer problem associated with this type of construction occurs if the "peel adhesion" between the PSA and abrasive side of the coated abrasive is greater than the internal cohesive threshold strength of the PSA. If this is true, the PSA can split and partially transfer to the abrasive coating side (PSA transfer). The problem is particularly acute in the finer abrasive particle grades of electrostatically coated abrasives since the finer grades have an increased surface area. This results in a higher peel adhesion for removal of PSA from the abrasive side of the coated abrasive.

One solution to the adhesive transfer and high unwind force problems is to have a paper or plastic release liner placed between the PSA coating and abrasive grains, as disclosed in U.S. Pat. No. 3,267,623 (Block). However, this becomes an additional expense for the customer and the liner must be disposed of. Additionally, where the coated abrasives are used to condition a surface for painting, and where the liner has a silicone-based coating, the silicone may be contaminate the unpainted surface, and may cause the paint to "bubble". Thus, many users prefer that PSA type coated abrasive discs do not have a liner (especially silicone-based) associated with them.

Coated abrasive articles are used to abrade a wide variety of substrates, including wood, wood like materials, plastics, fiberglass, soft metal alloys, enamel surfaces, and painted surfaces. One problem, to all of these different substrates is "loading" or clogging. Loading is the industry term that describes the phenomenon of particles from the workpiece being abraded becoming lodged in between the abrasive particles. Loading reduces the cutting ability of the abrasive article, and thus the useful life of the abrasive article is substantially reduced.

In an attempt to overcome this loading problem, Twombley, in U.S. Pat. No. 2,768,886, discloses the use of a metal stearate, metal palmitate or metal laurate coating over the abrasive surface. One theory for the success of these compounds is that this type of organic metal coating powders off of the abrasive surface, which in turns causes the abraded particles thus loaded to also powder off the abrasive surface, thus reducing loading.

Although abrasive articles which include anti-loading coatings of zinc stearate and other organic metal coatings have had wide commercial success, their use in some applications has the disadvantage in that such coatings are not coherent as in the case of a polymer and have a tendency to flake from the abrasive surface, and the flaked residue finds its way onto surfaces which the user would rather not have contaminated.

European Pat. App. 0 433 031 A1, Stubbs, published Jun. 19, 1991, describes abrasive elements having between the particles of abrasive material various fluorochemicals selected from two classes: compounds having fluorinated aliphatic group attached to a polar group or moiety, and fluoropolymers having a molecular weight of at least 750 and comprising a non-fluorinated polymeric backbone having a plurality of pendant fluorinated aliphatic groups.

U.S. Pat. No. 2,881,064, Rankin et al., discloses an organosilicone-based supersize coating which apparently prevents coated abrasives from loading. Examples of organosilicone supersized coatings include that comprised of dialkoxy diamino silane, a mixture of chloro and methyl silanes, the thermal setting organo-silicone resin containing a plurality of aromatic groups attached to silicon atoms, and highly polymerized dimethyl siloxane polymers.

U.S. Pat. No. 3,042,508, Hagis, teaches a metal-backed abrader having cutters spaced over the surface thereof and a supersize coating consisting essentially of a fluoroethylene polymer which apparently reduces loading.

U.S. Pat. No. 3,043,673, Klein, concerns a coated abrasive having an oxy-containing compound (for example aliphatic polyhydric alcohols or aliphatic polyethers) in the size resin to reduce loading.

U.S. Pat. No. 3,795,496, Greenwood, discloses a coated abrasive having a plasticized polyvinyl acetate supersize coating which apparently reduces loading.

U.S. Pat. No. 2,202,765, Guth, pertains to a coated abrasive having a size coating that is loading resistant, comprising the reaction product of polyhdyric alcohols or their anhydrides with other compounds with which they are adapted to react.

U.S. Pat. No. 2,532,011, Dahlquist et al., pertains to a pressure sensitive adhesive tape that contains a low adhesion backside coating of a polyvinyl carbamate.

U.S. Pat. No. 4,988,554 (Peterson et al.) teaches a coated abrasive article which contains a lithium salt of a fatty acid supersize to reduce the amount of loading. On the nonabrasive side is a pressure sensitive adhesive coating. When the coated abrasive is packaged, the lithium salt of the fatty acid apparently prevents significant transfer of the pressure sensitive adhesive to the abrasive grains.

U.S. Pat. No. 4,973,338 (Gaeta et al.) pertains to a coated abrasive that has improved anti-static, lubricity and antiloading properties. The coated abrasive has a supersize coating comprising a quaternary ammonium compound, which has from about 15 to 35 carbon atoms and a molecular weight not less than about 300. Examples of the quaternary ammonium compounds include (3-lauramido-propyl)trimethylammonium methyl sulfate, stearamidopropyldimethyl-betahydroxyethylammonium nitrate, N,N-bis(2-hydroxyethyl)-N-(3''-dodecyloxy-2''-hydroxypropyl)methylammonium methylsulfate and stearamidopropyl-dimethyl-betahydroxyethylammonium dihydrogen phosphate.

Other patents of interest include U.S. Pat. Nos. 3,869,834; 4,720,941; 5,061,294; 4,563,539; 4,359,369; 4,554,339; 4,597,987; 4,313,988; 4,822,687; 4,269,963; 4,743,474; 4,530,882; and 4,525,566. Practical difficulties in processing silicones are discussed in Huettner, D. J., in a conference paper entitled "Moisture Curing Silicone Release Coating Technology; A Coating Process is the Missing Component", presented at the 1988 Pressure Sensitive Tape Council Technical Seminar.

Of the above-mentioned constructions, while some are concerned with loading resistant coatings and some with transfer of adhesive to the abrasive surface, the finer grades of coated and other abrasives continue to suffer reduced performance due to adhesive transfer.

SUMMARY OF THE INVENTION

The present invention provides an abrasive article including a substrate having on a surface thereof particles of an abrasive material secured by a binding medium to form an abrasive surface. At least a portion of the abrasive surface has thereon a coating comprising a crosslinked siloxane, the crosslinked siloxane comprising the condensation reaction product of (a) about 1 to about 100 percent by weight of polymer selected from the group consisting of polymers of the general formula:

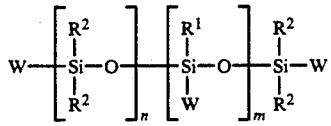

(I)

and mixtures thereof:

wherein n and m each represent integers, wherein the sum of n plus m is an integer of about 20 to about 5000;

m has a value ranging from about 0 to about 0.1(n+m);

n is an integer of about 20 to about 5000;

$R^1$ are monovalent moieties which can be the same or different selected from the group consisting of alkyl, substituted alkyl, aryl, and substituted aryl;

$R^2$ are monovalent moieties which can be the same or different selected from the group consisting of alkyl, substituted alkyl, aryl, and substituted aryl;

W are monovalent moieties which can be the same or different selected from the group consisting of alkyl, substituted alkyl, aryl, substituted aryl, and reactive hydrolyzable group

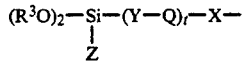

wherein at least about 50% of the total number of silicon atoms excluding those in said reactive hydrolyzable group(s) have two methyl groups bonded thereto, and wherein at least one reactive hydrolyzable group

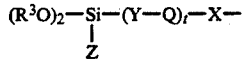

appears on the polymer of Formula I and further wherein at least about 25% of the polymers of Formula I in the coating have at least two reactive hydrolyzable groups

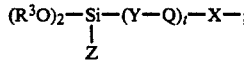

wherein

X are divalent linking groups which can be the same or different selected from the group consisting of alkylene groups comprising about 1 to about 12 carbon atoms;

Q are divalent linking groups which can be the same or different selected from the group consisting of urea, amide, urethane, thiourethane, ether and thioether groups;

Y are divalent linking groups which can be the same or different selected from the group consisting of alkylene groups comprising about 1 to about 12 carbon atoms;

t is an integer of 0 to 10;

Z are monovalent moieties which can be the same or different selected from the group consisting of —OR and —R wherein R is an alkyl group comprising about 1 to about 3 carbon atoms; and $R^3$ is a monovalent alkyl group comprising about 1 to about 3 carbon atoms;

(b) about 0 to about 99% by weight of a component selected from the group consisting of compounds and polymers of the general Formula II:

$$(R^3O)_3—Si—A \quad (II)$$

hydrolysates thereof, and mixtures thereof wherein $R^3$ is defined as above;

A is a monovalent moiety selected from the group consisting of —$OR^3$, a monovalent alkyl group comprising about 1 to about 20 carbon atoms, and —X—$(Q)_p$—$[D—Q]_t$—$(Y)_b$—$Si(OR^3)_3$ wherein X, Q, t, Y and $R^3$ are defined as above;

D is a divalent group which can be the same or different selected from the group consisting of alkylene group comprising from 2 to about 30 carbon atoms, aralkylene groups comprising from about 6 to about 30 carbon atoms, arylene groups comprising from 6 to about 30 carbon atoms, divalent polymeric segments having a number average molecular weight of 500 to about 10,000 selected from the group consisting of polyether, polyolefin, polyester, polydiene, and mixtures thereof;

p is an integer from 0 to 1; and b is an integer from 0 to 1;

wherein when t is an integer of 1 to 10, b must equal 1 and p must equal 1; and when t=0 and b=0, p must also equal 0;

wherein the weight percentages of (a) and (b) are based upon the total weight of (a) plus (b); and (c) about 1 to about 15% by weight based upon the total weight of (a) plus (b) of a component selected from the group consisting of acids having pKas of less than about 3, anhydrides of acids having pKas of less than about 3, ammonium and lower alkyl ammonium salts of acids having pKas of less than about 3, and mixtures thereof.

The crosslinked siloxanes of Formula I can include polymers compatible with the siloxane, such as polypropylene oxide and polyethylene oxide, as in Formula II. The advantages of this flexibility of coating composition are described herein.

Another family of compounds having release and load resistant properties and suitable for use in the present invention are the crosslinked versions of polydimethyl silicones having from about 5-25 mole percent epoxy cyclohexyl ethyl pendant substituents, within Formula III:

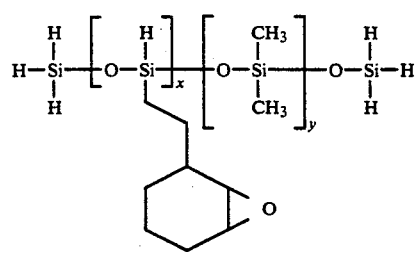

(III)

and mixtures thereof, wherein x may range from about 6 to about 12 and y may range from about 55 to about 110, with the total molecular weight of Formula III ranging from about 6000 to about 12,000. Polymers within Formula III copolymerize in the presence of diaryl oniums, such as diaryl iodonium hexafluoroantimonate, Formula IV:

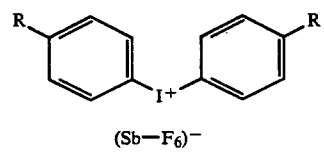

(IV)

wherein R are the same or different selected from the group consisting of alkyls, substituted alkyls, aryls, and substituted aryls having from about 1 to about 15 carbon atoms. Abrasive articles wherein at least a portion of the abrasive surface has thereon a coating of crosslinked polymers within Formula III cured by the addition of (IV) are another aspect of the invention.

Another aspect of the invention pertains to an article from which sheet-like segments of pressure sensitive adhesive-backed coated abrasive can be removed, each segment having an abrasive front surface. The article includes a plurality of sheet-like segments of pressure sensitive adhesive backed coated abrasive, wherein a first segment of pressure sensitive adhesive-backed coated abrasive has its abrasive front surface temporarily adhered to the pressure sensitive adhesive-coated backside of an adjacent pressure sensitive adhesive-coated abrasive. The abrasive front surface of each of the plurality of sheet-like segments includes a coating comprising a crosslinked siloxane as previously described. Preferred are those articles wherein the sheet-like segments are within a continuous strip of coated abrasive which is wound into a roll; wherein the sheet-like segments are at least partially overlapped to form a stack; and where each of the sheet-like segments are edge-wise connected to at least one other sheet-like segment by easily severed edge connections, thus enabling the sheet-like segments to be wound into a roll.

A further aspect of the invention is a method of making an abrasive article, the abrasive article comprising a substrate having on a surface thereof particles of abrasive material secured by a binding medium to form an abrasive surface wherein at least a portion of the abrasive surface has thereon a coating comprising a crosslinked siloxane, wherein the crosslinked siloxane is as above described. The method comprises applying a coatable slurry to a front side of a backing, the slurry comprising a plurality of abrasive particles dispersed in a binder precursor solution, subjecting the slurry coated backing to conditions which cure the binder precursor solution, applying a siloxane composition over at least a portion of the abrasive coating, the siloxane composition curing to a crosslinked siloxane coating upon exposure to moisture. Preferred are those methods wherein the crosslinked siloxane is in the form of a coating supplied by a method selected from the group consisting of roll coating, spray coating, gravure coating, electrospray coating, flow bar-meter roll coating, curtain coating, and combinations thereof.

A method of abrading a workpiece using an abrasive article is also presented, the abrasive article including a substrate having on a surface thereof particles of abrasive material secured by a binding medium to form an abrasive surface wherein at least a portion of the abrasive surface has thereon a coating comprising a crosslinked siloxane, the crosslinked siloxane as above described, the method including creating relative movement of the abrasive surface and the workpiece while the surface and the workpiece are forcibly touching.

Preferably, the crosslinked siloxane coating is an ultrathin coating of at least about 0.1 micrometer, preferably not greater than about 1.0 micrometer, more preferably less than about 0.8 micrometer, most preferably ranging from about 0.1 to about 0.8 micrometer. The crosslinked siloxane coating will preferably provide a coated abrasive with an initial 180° peel adhesion strength (i.e., when the crosslinked siloxane is initially placed in direct contact with the pressure sensitive adhesive of another coated abrasive) of less than about 10.0 gm/cm, more preferably less than about 4.0 gm/cm, but in all cases greater than about 0.1 gm/cm. Initial 180° peel adhesion values greater than this may render the separation of two sheets difficult for the user, while values less than 0.1 gm/cm are unacceptable from the standpoint that there would be substantially no adhesion between a PSA and crosslinked siloxane-coated abrasive.

It has been determined that crosslinked siloxanes as herein described provide abrasive articles with reduced loading and reduced pressure sensitive adhesive transfer when a pressure sensitive adhesive backside coating is employed in the abrasive articles and when the PSA coating of one abrasive article is temporarily adhered to the abrasive side of another abrasive article.

Further aspects and advantages of the invention will become apparent from the drawing and description which follows.

DESCRIPTION OF PREFERRED EMBODIMENTS

Figure 1:
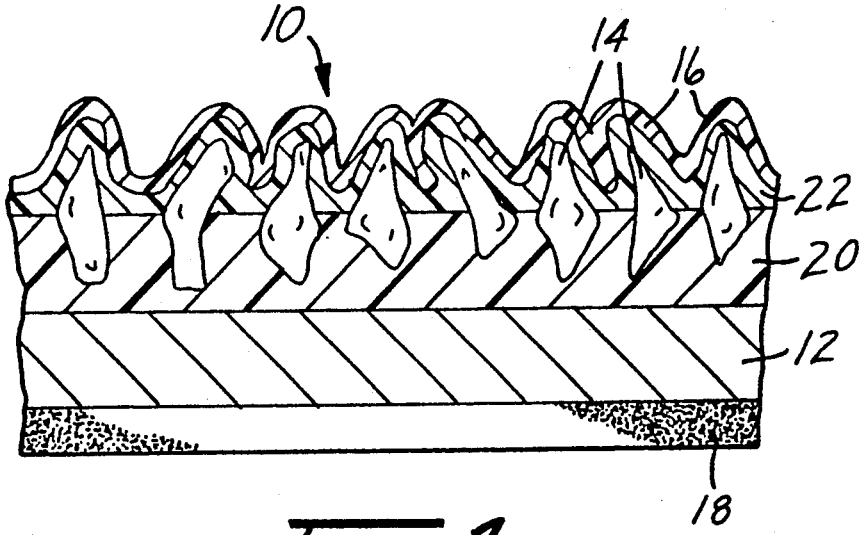
FIG. 1 is a cross-sectional view (enlarged) of one embodiment of a coated abrasive article of the invention including a crosslinked siloxane supersize coating.

As previously noted, one aspect of this invention is an abrasive article comprising a substrate having on a surface thereof particles of an abrasive material secured by a binding medium to form an abrasive surface, wherein at least a portion of the abrasive surface has thereon a coating comprising a crosslinked siloxane. The invention is now described in more detail.

CROSSLINKED SILOXANES

The presence of a crosslinked siloxane in at least the layer forming the exposed surface of the abrasive article is found to confer antiloading and PSA-release properties upon the material so treated. As used herein, the terms "crosslinked siloxane coating" and "siloxane composition" refer to the cured and uncured versions of the siloxane, respectively.

The crosslinked siloxane coating may be a layer coated over the existing layers of an abrasive article or may be incorporated into at least the composition which will form the outer layer. Thus, the crosslinked siloxane may be incorporated into the make coating of an abrasive element consisting of a single layer; the crosslinked siloxane may be incorporated into the size coating of an abrasive element consisting of make and size coatings, or the crosslinked siloxane may be incorporated into the supersize layer of an abrasive article consisting of a make, size and supersize coating layers. If more than one supersize coating layer is present the crosslinked siloxane is preferably incorporated into the outermost supersize layer. However, metal stearates and other known load resistant or release coatings may be applied over the crosslinked siloxane coating.

The crosslinked siloxane coatings described in the present invention are suitable for application to a wide variety of abrasive materials or products, serving to reduce the loading of the abrading surface in use and thereby extending the working life of the material. The abrasive elements may be in the form of sheets, blocks, discs, pads, belts, and the like, or rigid or flexible 3-dimensional arrays of fibers, for example, of the type commercially available from Minnesota Mining and Manufacturing Company under the trade designation "SCOTCH-BRITE". Abrasive articles of the invention may be advantageously used in either dry or wet abrading conditions since the crosslinked siloxane provides a degree of water repellency.

The functional polysiloxanes which are component (a) of the invention are represented by Formula I. Examples of preferred polysiloxanes comprise the polysiloxanes selected from group consisting of Formula I, wherein $R^1$ and $R^2$ each comprise methyl, X and Y each comprise $—CH_2CH_2CH_2—$, t equals 1, and Q is selected from the group consisting of urea and thioether groups. These moieties are preferred because of the commercial availability and ease of preparation of starting materials having these functionalities or their precursors. Preferred polysiloxanes comprises at least one trialkoxysilane terminal or pendant group, wherein Z comprises $—OCH_3$ and $R^3$ comprises $—CH_3$ due to the enhanced hydrolytic activity of the resultant trimethoxysilane terminal and/or pendant groups.

The sum of n plus m must represent an integer of about 20 to about 5000, in order to provide a functional polysiloxane that yields a crosslinked siloxane coating having the required release force and rheological properties. If the sum of n plus m is much less than about 20, the adhesive properties of a crosslinked siloxane coating prepared therefrom are diminished due to an insufficient number of dimethylsiloxy groups in the polysiloxane chain. If the sum of n plus m is greater than about 5000, the viscosity of the crosslinked siloxane coating composition becomes too high for current coating practices and processes. Preferably, the sum of n plus m is an integer of about 70 to about 1000, most preferably about 70 to about 500, a range that balances these release and rheological concerns.

The value of m is less than about 0.1 (n+m). Among other factors, the release properties of the crosslinked siloxane coating of the invention is dependent on the number of dimethylsiloxane segments in the polymer backbone of the polymer of formula I. Thus, the number of pendant reactive hydrolyzable groups must be restricted to ensure an adequate ratio of dimethylsiloxane repeating units in the functional polysiloxanes of Formula I.

The trialkoxysilyl substituted polysiloxanes of Formula I are conveniently prepared from the reaction of appropriate trialkoxysilyl substituted reagents with various functionally reactive polysiloxanes. Thus, a polymer of Formula I wherein the terminal W groups each comprise a methyl group and wherein the pendant W groups comprise thio-linked, trimethoxysilyl functional reactive hydrolyzable groups, may be obtained from the free radically induced addition of, for example, commercially available mercaptopropyl-substituted polysiloxanes with vinyltrimethoxysilane. In a similar fashion, reaction of isocyanatopropyl triethoxysilane with another commercially available polysiloxane having pendant aminopropyl groups provides polymers of Formula I with dipropylurea links. Difunctional polysiloxanes may be formed by the treatment of bis(aminopropyl) terminated polysiloxanes, either from commercial sources or prepared via the method described in copending U.S. patent application Ser. No. 07/671,172, incorporated by reference herein, with isocyanatopropyl triethoxysilane and m=0.

U.S. patent application Ser. No. 07/671,172 describes several methods for synthesizing organopolysiloxane diamines useful in the preparation of difunctional polysiloxanes useful in the present invention. In a first method, an organopolysiloxane terminated at both chain ends with hydroxy groups, as represented by the general Formula

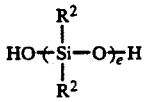

V where $R^2$ is as defined above and e is an integer of about 270 to about 1000, can be subjected to a condensation reaction with a compound represented by the general Formula

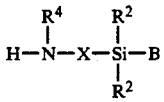

VI where X, and $R^2$ are as defined above, B is a hydroxy group or a hydrolyzable group, and $R^4$ is selected from the group comprising of hydrogen, an alkyl group comprising about 1 to about 10 carbon atoms, aryl, and substituted aryl. A second method involves the reaction of a cyclic organosiloxane, represented by the general Formula

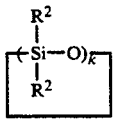

VII where $R^2$ is as defined above and k is a positive integer of 3 to 8, with an amine functional endblocker, represented by the general Formula

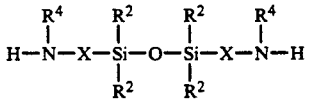

VIII where $R^4$, X, and $R^2$ are as defined above, in the presence of a basic catalyst such as tetramethylammonium hydroxide or triorganosilanolate. A third method, a modification of the second, is preferred and involves running the reaction in two stages utilizing a minimum amount of an essentially anhydrous amino alkyl functional silanolate catalyst represented by the general Formula

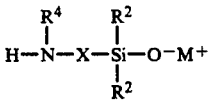

IX where $R^4$, X, and $R^2$ are as defined above and $M^+$ is a cation selected from the group consisting of $K^+$, $Na^+$, and tetraorganoammonium ion, with $N(CH_3)_4^+$ being preferred. In the first stage of the reaction, a low molecular weight organopolysiloxane diamine, represented by the general formula

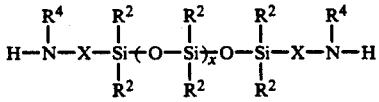

X where $R^4$, X, and $R^2$ are as defined above and x is an integer of about 4 to about 40, is prepared by reacting an amine functional disiloxane endblocker represented by Formula VIII above with a cyclic organosiloxane represented by Formula VII in the presence of a catalytic amount of essentially anhydrous amino alkyl functional silanolate represented by Formula IX in an inert atmosphere such as nitrogen or argon. The preferred catalyst for use in this reaction is 3-aminopropyl dimethyl tetramethylammonium silanolate, which can be obtained as a crystalline solid from the reaction of one molar equivalent of 1,3-bis(3-aminopropyl) tetramethyldisiloxane with two molar equivalents of tetramethylammonium hydroxide pentahydrate in tetrahydrofuran under reflux, followed by drying under vacuum for five hours (0.1 mm) at 60° C. The amount of catalyst employed should be less than about 0.05 percent, preferably about 0.005 to about 0.03 percent, by weight of the resultant organopolysiloxane diamine. The reaction can be carried out in bulk at a temperature of about 80° C. to about 90° C., and under these conditions is usually complete in about 0.5 to about 2 hours, as judged by substantially complete disappearance of the endblocker of the reaction mixture as determined by vapor phase chromatography. The second stage of the reaction involves the slow addition of the remainder of the cyclic organosiloxane required to achieve the desired molecular weight. This addition is preferably carried out dropwise at such a rate that the cyclic organosiloxane is incorporated into the polymer about as fast as it is added, usually in about five to seven hours at the reaction temperature of about 80° C. to about 90° C. By utilizing this two-stage method with a minimum amount of essentially anhydrous catalyst, organopolysiloxane diamines, useful in the preparation of the difunctional polysiloxanes useful in this invention can be consistently prepared having excellent difunctionality with little contamination from monofunctional and nonfunctional polysiloxane impurities.

Finally, for monofunctional polysiloxanes of Formula I in which one terminal W group comprises an alkyl group, m=0, and the other W group comprises dialkyl urea linked triethoxysilane, the starting monoamine is obtained from the well known anionic polymerization of hexamethylcyclotrisiloxane initiated with n-butyl lithium and terminated with the capping reagent, 3-aminopropyl dimethyl fluorosilane, as described in copending U.S. patent application Ser. No. 07/671,172, incorporated by reference herein.

Termination of the anionic polymerization is, in general, achieved via direct reaction of the living polymeric anion with fluorine-containing terminating agents, i.e., functionalized fluorosilones, to produce amine terminated polymeric monomers. The termination reaction is carried out by adding a slight molar excess of the terminating agent (relative to the amount of initiator) to the living polymer at the polymerization temperature.

This preferred capping reagent is prepared by combining 1,3-bis(aminopropyl)tetramethyldisiloxane and a hydrocarbon solvent having a boiling point ranging from about 75° C. to about 85° C. in order to form a solution. Suitable hydrocarbon solvents include cyclohexane, benzene, heptane, and the like. The solution thus formed is reacted by combining the solution with at least about a molar equivalent of an acidic fluoride reactant, preferably at least about a 5 percent molar excess of an acidic fluoride reactant, such as hydrofluoric acid, potassium bifluoride, ammonium fluoride, or the like, preferably ammonium fluoride, with azeotropic removal of water. This provides the amine hydrofluoride substituted fluorosilane isolated as the crystalline hydrofluoride salt precipitate, which can then be converted to the free amine by heating a slurry of the salt in a water-immiscible solvent boiling in the range of about 35° C. to about 50° C., e.g., methylene chloride, with about a 1 percent molar excess to about a 5 percent molar excess of a compound selected from the group consisting of monosubstituted or disubstituted lower alkylamino silanes and hexamethyl disilazane. The amine-substituted fluorosilane can be separated from the solvent by evaporation of the solvent and distillation of the product under reduced pressure.

The crosslinked siloxane coating useful in abrasive articles of the invention comprises about 1 to about 100 percent by weight of polymer cf Formula I, preferably about 5 to about 30% for use as low adhesion backsizes, and from about 50 to about 90% for applications requiring easier release based upon the total weight of components (a) plus (b). Component (a) of the crosslinked siloxane coating comprises at least 25% polydiorganosiloxane of Formula I having at least two reactive, hydrolyzable functional silane groups per molecule. Component (a) can comprise mixtures of difunctional or multifunctional polysiloxane polymer of Formula I with polysiloxanes of Formula I having only one terminal, hydrolyzable, reactive silane group. Mixtures of all three, monofunctional, difunctional and multifunctional polysiloxanes of Formula I are also possible. The exact composition is dependent on such factors as the requirements of the coating process, the release and/or loading resistant requirements of the abrasive surface employed, and other associated elements encountered in each particular application.

When component (a) comprises monofunctional terminal silanes of Formula I blended with difunctional polysiloxanes, multifunctional polysiloxanes, or mixtures thereof, no more than 75 percent, and preferably, no more than about 60 percent of the polymers of Formula I should comprise monofunctional polysiloxanes. Incorporation of increasing amounts of the monofunctional polysiloxanes of Formula I (i.e., having only one reactive trialkoxysilane substituent) in the formulation tends to reduce the surface friction as well as, in many instances, lower the level of release of the cured crosslinked siloxane coating. Incorporation of an excess of monofunctional polysiloxane, however, may lead to a slow and/or incomplete cure. On the other hand, increasing the number of reactive functional groups in the polysiloxanes of Formula I, or increasing the amount of these multifunctional polysiloxanes in mixtures of monofunctional and difunctional polysiloxanes, tends to have the effect of increasing the rate of cure of the compositions.

The moisture curable crosslinked siloxane coating useful in abrasive articles of the invention also comprises about 0 to about 99 percent by weight of a non-polysiloxane containing component selected from the group consisting of compounds and polymers of Formula II, hydrolysates thereof, and mixtures thereof. If the non-polysiloxane component is included, the release coating composition typically comprises about 1 to about 99 percent by weight non-polysiloxane of component (b) and about 1 to about 99 percent by weight polysiloxane of component (a) based upon the total weight of (a) plus (b). These non-polysiloxane containing components may be used to adjust the viscosity of the uncured composition or to impart additional desirable characteristics to the cured crosslinked siloxane coatings. For example, incorporation of up to about 50% by weight of component (b) with component (a) provides cured coatings which exhibit the same easy level of release of the pure, cured polysiloxane component (a), but with better mechanical strength and adhesion to substrates. To obtain release coatings with higher levels of peel adhesion, compositions having significantly greater amounts of non-polysiloxane component (b), from about 70 to about 99 percent, preferably about 80 to about 95 percent, based upon the total weight of (a) plus (b), are utilized. Crosslinked siloxane coating compositions with these levels of non-polysiloxane component provide increasing levels of release force in a controlled manner.

Examples of useful non-polysiloxane containing compounds having terminal alkoxysilyl groups include but are not limited to those selected from the group consisting of alkoxysilyl terminated alkanes, alkoxysilyl terminated ethers, alkoxysilyl terminated thioethers, tetraalkoxysilyl compounds, trialkoxysilyl terminated polymeric derivatives, such as trialkoxysilyl terminated polypropylene oxide, polyethylene oxide, polytetramethylene oxide, polycaprolactone, and the like, and mixtures thereof.

During the cure of a siloxane composition which comprises both components (a) and (b), in addition to (c), atmospheric moisture hydrolyzes the silane groups of both Formula I and Formula II to intermediate SiOH groups which ultimately undergo condensation to form Si—O—Si bonds in a random fashion to provide crosslinked silicate networks in which the functional polysiloxanes of Formula I are chemically bonded to the non-polysiloxane Formula II. Thus the corresponding hydrolysates of silane functional components Formula II, i.e., silicate resins, colloidal silica, etc., can be used in place of or in addition to Formula II in component (b) of the compositions of this invention. If hydrolysates are included, the release coating composition preferably comprises about 1 to about 15 percent by weight of a hydrolysate such as colloidal silica based upon the total weight of components (a) plus (b). Component (b) may optionally also include, in addition to the hydrolysate(s), compounds and/or polymers of Formula II. The release coating composition of the invention comprises about ; to about 15 weight percent of component (c) based upon the total weight of (a) plus (b), wherein component (c) is selected from the group consisting of acids having pKas of less than about 3, anhydrides of acids having pKas of less than about 3, ammonium salts of acids having pKas of less than about 3, lower alkyl ammonium salts of acids having pKas of less than about 3, and mixtures thereof. Lower alkyl ammonium salts of the acids refer to the products obtained from the neutralization of acids with amines having alkyl substituents of from about 1 to about 3 carbon atoms. Preferably component (c) comprises an organic acid or a derivative thereof in order to ensure most efficient and effective cure.

In order to facilitate a more rapid cure, the acidic component (c) should preferably comprise about 3 to about 10 weight percent based upon the combined weights of components (a) plus (b). Preferably the acid should have a pKa of about 0.1 to about 1.5 in order to ensure a more complete and efficient conversion of the hydrolyzable alkoxysilane groups of the composition. If greater than about 15 weight percent of component (c) is included in the siloxane composition which cures to form the crosslinked siloxane coating, no additional benefit is achieved, and the excess acid or acid derivative component becomes a non-incorporated diluent which may actually have a deleterious effect on the performance of the release composition. On the other hand, if insufficient component (c) is included, the hydrolysis of the alkoxysilane functionalities and subsequent condensation to crosslinked siloxane coatings occurs too slowly.

Examples of useful acids, anhydrides, and lower alkyl ammonium salts thereof of component (c) include but are not limited to those selected from the group consisting of trichloroacetic acid, cyanoacetic acid, malonic acid, nitroacetic acid, dichloroacetic acid, difluoroacetic acid, trichloroacetic anhydride, dichloroacetic anhydride, difluoroacetic anhydride, triethylammonium trichloroacetate, trimethylammonium trichloroacetate, and mixtures thereof.

Catalyzed by component (c), the siloxane compositions cure to solid, crosslinked polysiloxane coatings via the hydrolysis of the alkoxysilane endgroups and condensation to silicate networks. When cast in thin films, as is the case for load resistant or release coatings, the reaction occurs extremely rapidly, typically curing to clear, smear-free, and well anchored coatings in 60 seconds or less.

The moisture curable siloxane compositions which are employed to make the crosslinked siloxane coated abrasive articles of this invention may be applied to substrates by most standard coating techniques, either as dilute solutions in organic solvents or as neat liquids. When cast from solvent, component (c) of the composition may be present either as the free acid, as an anhydride, as an amine salt, such as triethylammonium, or as a mixture thereof. Suitable solvents include but are not limited to volatile organic liquids which will dissolve the compositions of the invention, including but not limited to those selected from the group consisting of alkanes, arenes, chlorinated hydrocarbons, lower alkanols, and mixtures thereof. If a solvent is utilized, the composition may be included in the solvent at a concentration as low as about 2 percent solids. In the free acid form, curing of the functional polysiloxane occurs almost instantaneously upon evaporation of the solvent from the coated substrate. In the ammonium salt form, however, the catalyst is inactive, and cure does not take place until the dried coating is heated sufficiently to dissociate the salt and drive off the amine to liberate the free acid catalyst and initiate the moisture cure. The temperatures required for this will vary depending on the particular organic acid employed, but generally is in the range of from about 50° to about 150° C., preferably about 80° to about 110° C.

When coating very high solids solutions (i.e., about 80 percent solids or more) or neat materials, it is essential to utilize the lower alkyl ammonium salt form of the acid as component (c). Otherwise, it is not possible to avoid premature reaction with atmospheric moisture and subsequent gellations. With the inactivated lower alkyl ammonium salt form of component (c), it is thus possible to coat the release coating compositions of this invention at 100% solids in atmospheric moisture using standard coating techniques, such as gravure, offset gravure, and electrospray, without premature curing. Cure is then activated by heating the coating as described above.

The coating compositions of the invention preferably consist essentially of components (a), (b), and (c) and optional solvent or components (a) and (d) and optional solvent, most preferably the release coating compositions of the invention consist of components (a), (b), and (c) and optional solvent or components (a) and (c) and optional solvent.

Abrasive articles of this invention employing crosslinked siloxane coatings generally employ a substrate, which can be a sheet, a fiber, or a shaped object. However, the preferred substrates are those used for pressure-sensitive adhesive products. The composition can be applied to at least one major surface of suitable flexible or inflexible backing materials and then cured. Useful flexible backing materials include paper, plastic films such as poly(propylene), poly(ethylene), poly(vinyl chloride), poly(tetrafluoroethylene), polyester [e.g., poly(ethylene terephthalate)], polyamide film such as duPont's Kapton TM, cellulose acetate, and ethyl cellulose, although any surface requiring release toward adhesives can be used. Backings can thus also be of woven fabric formed of threads of synthetic or natural materials such as cotton, nylon, rayon, glass, or ceramic material, or they can be of nonwoven fabric such as air-laid webs of natural or synthetic fibers or blends of these. In addition, suitable backings can be formed of metal, metallized polymeric film, or ceramic sheet material. Primers can be utilized, but they are not always necessary.

In most cases, the release coating composition of this invention provides coatings which possess the desired level of release immediately upon curing. Thus, the composition is suitable for use in the integrated manufacture of PSA-coated abrasives. The specific level of release provided upon curing can be controllably varied through variation in the weight percentage and molecular weight of the functional polysiloxane of Formula I included in the composition.

A sufficiently high amount of difunctional and/or multifunctional siloxanes (i.e., siloxanes having two or more reactive hydrolyzable groups) must be present to ensure a high and rapid degree of alkoxysilane hydrolysis conversion and complete cure of the polysiloxane. Thus, crosslinked siloxane coatings of the invention obtained via the moisture cure contain little or no free silicone to adversely affect the tack and peel properties of PSAs which come in contact with them. The siloxane composition used to form the crosslinked siloxane coating cures rapidly to firmly anchored, highly crosslinked, solvent resistant, tack-free coatings which have utility for a broad range of PSA types such as natural rubber-based, acrylic, and other synthetic, film-forming elastomeric materials.

Reaction of aminoalkyl-functional polydialkyl siloxane polymers with isocyanato alkyl trialkoxy silanes provides a series of silicone polymers within Formula I having wide ranging number average molecular weights ($M_n$), ranging from about 5,000 to about 75,000, more preferably from about 5,000 to 50,000. Under acidic conditions, when the polymers are thinly coated onto a substrate, the polymers within Formula I undergo rapid hydrolysis at the R—O bonds when moisture (typically atmospheric moisture) is present, and subsequently condense to solid, crosslinked siloxanes. The condensation reaction may proceed more rapidly upon the application of heat, typically about 70° C. to about 120° C. These crosslinked siloxanes are particularly well suited to comprise load-resistant and/or release coatings on abrasive articles of the present invention.

Through variations in the polymeric structure within Formula I, the crosslinked siloxane composition can be modified to afford abrasive articles of the invention with virtually no transfer of PSA to the coated abrasive, some PSA transfer or whatever degree adhesive transfer is acceptable for the particular application. The condensation reaction which produces the crosslinked siloxanes offers the advantages of extremely rapid, reproducible and reliable curing under mild conditions; precise control over ease of release of an abrasive surface from a PSA coated surface through simple structural modifications within Formula I; and substantially no loss of PSA performance due to siloxane transfer to the PSA.

A specific series of reactions I and II, below illustrates the reaction mechanism for producing the crosslinked siloxanes used in the abrasive articles of the invention. Reaction I shows the reaction of α-ω-bis-(aminopropyl)polydimethylsiloxane with isocyanatopropyl triethoxysilane, providing a urea-ethoxysilane functional polydimethylsiloxane polymer with highly reactive terminal groups wherein x can range from about 10 to about 200.

(I)

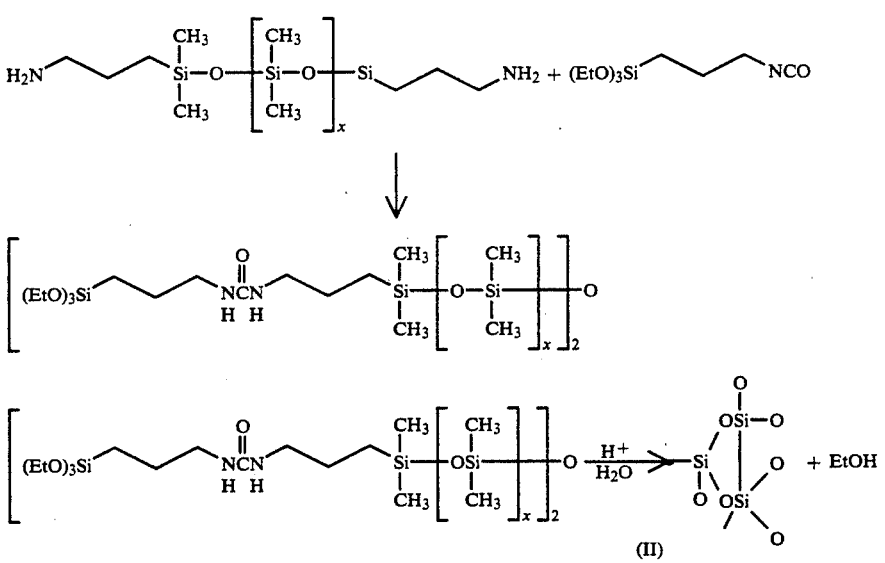

(II)

The urea-ethyoxysilane functional polydimethylsiloxane polymer produced from reaction I subsequently condenses in the presence of acids and water to solid, crosslinked siloxane elastomers via hydrolysis of the ethyoxysilane end groups and subsequent condensation to the crosslinked siloxane (Reaction II). Typical acids used in the condensation reaction include trichloracetic acid, hydrochloric acid, and other organic and inorganic sources of hydrogen ion. The preferred strong acid is trichloroacetic acid.

When polymers within Formula I are combined with an acid catalyst in the presence of moisture, and coated in thin films on a substrate, Reaction II was found to occur extremely rapidly. Premature gelation may be prevented by adding a small amount of low molecular weight alcohol, such as methanol or ethanol, and a water scavenger such as trimethyl orthoformate or dimethoxy methane. These high solid solutions dry to tack-free coatings in seconds after application of polymers within Formula I on a substrate using rollcoating methods described herein below. Alternatively, as is also further explained hereinbelow, polymers within Formula I may be sprayed onto a substrate utilizing an electrospray process. In the case of the electrospray process, polymers within Formula I are preferably mixed with a reactive diluent such as tetraethoxysilane to render the polymers sprayable. Preferably, the reactive diluent is present in an amount ranging from about 10% to about 30% per weight of polymer, more preferably ranging from 15 to 25% by weight of polymer.

When it is desired to utilize an abrasive article from an article from which sheet-like segments of pressure-sensitive adhesive-backed coated abrasive can be removed, wherein each segment has an abrasive front surface and a PSA-coated backside surface, the crosslinked siloxanes described herein may reduce the amount of PSA transfer to the abrasive front surface of an adjacent coated abrasive. The crosslinked siloxanes may also reduce the force required to unwind a roll of such coated abrasive. The choice of the particular crosslinked siloxane employed and its thickness are functions of the particular PSA employed, the temperature the article is experiencing or will experience, humidity, and the degree to which adhesive transfer is to be reduced. It has been found in accordance with this invention that the crosslinked siloxane and PSA should be chosen such that the initial 180° peel strength of the bond between a crosslinked siloxane-coated abrasive surface and a PSA is less than about 10.0 gm/cm, preferably less than about 4.0 gm/cm, but in all cases more than about 0.1 gm/cm. The 180° peel strength of the bond can be measured according to a standardized test as discussed further in the section entitled "Test Methods", below.

As mentioned previously, in addition to the diaminopolydimethyl siloxanes used specifically in Reaction I, high purity monoamine-functional polydialkyl siloxanes have become available; reaction of these with isocyanato trialkoxysilanes provide monourea-alkoxy silanes. Monourea-alkoxy silanes within Formula I may be formulated with diamino-functional polydialkyl siloxanes also within Formula I, and cured in the same manner as Reaction II, in which case the crosslinked siloxane contains silicone "grafts" at the crosslink points.

Similarly, multifunctional polymers within Formula I having pendant aminopropyl substituents which are endcapped with isocyanato trialkoxysiloxanes may be incorporated into the crosslinked siloxane. An example of such a crosslinked siloxane is that having 60 weight percent diaminopolydimethylsiloxane, 25 weight percent monoaminopolydimethylsiloxane, and 15 weight percent multiaminopolydimethylsiloxane, with other variations of course being possible.

A semi-quantitative measure of the ability of a particular release coating to eliminate or substantially reduce adhesive transfer to particular abrasive coatings having various abrasive grain sizes is useful, an example of which is shown in Table 1 for one crosslinked siloxane useful in abrasive articles described herein (other tables can easily be developed for other grades of abrasives and release coatings). The data for Table 1 were developed by placing a stack of identical coated abrasive discs (known under the trade designation "Imperial", from Minnesota Mining and Manufacturing Company) having the cross-sectional structure as shown schematically in FIG. 1. The PSA 18 on one disc was in contact with the crosslinked siloxane-coated abrasive surface of another disc and the stack placed in an oven at 50° C. for 3 days, under a weight sufficient to produce a downward pressure of 74 gm/cm$^2$. The PSA used for the 30 micrometer abrasive particle size discs was a hot-melt acrylate PSA, while for the 9 micrometer abrasive particle size discs, an acryl amide PSA was employed. Note that a crosslinked siloxane coating thickness of over 0.1 micrometer is required on the 30 micrometer grade for no PSA transfer of the hot-melt acrylate PSA.

TABLE 1

| Release Coating Thickness, Micrometer | Average Abrasive Grain Size, Micrometers** | Rating* |
|---|---|---|
| 0 | 9 | 6 |
| | 30 | 4 |
| 0.1 | 9 | 4 |
| | 30 | 2–3 |
| 0.25 | 9 | 3–4 |
| | 30 | 2 |
| 0.4 | 9 | 3–4 |
| | 30 | 1 |

*1 = Easy separation, no PSA transfer.
2 = Some resistance to separation, no PSA transfer.
3 = Resistant to separation, possible PSA transfer.
4 = Resistant to separation, PSA transfer less than 1% by area of total PSA area.
5 = Hard to separate, PSA transfer less than 5% by area of total PSA area.
6 = Difficult to separate, PSA transfer greater than 5% by area of total PSA area.
**"9" and "30" refer to the microfinishing films known under the trade name "Imperial" having the stated average abrasive grain sizes, available from Minnesota Mining and Manufacturing Company, St. Paul, MN.

Pressure Sensitive Adhesives

A wide variety of PSAs may be used with the crosslinked siloxane-coated abrasive articles of the present invention. PSAs having 180° peel adhesion ranging from about 170 to about 1000 gm/cm, more preferably ranging from about 390 to about 560 gm/cm, are all useful PSAs, the 180° peel adhesion measured using the test procedure "a. Test Substrate=glass surface", explained in the Test Methods Section. Internal cohesive strength (shear strength) can range from about 1 minute to over 10,000 minutes.

The shear strength is a measure of the cohesiveness or internal strength of an adhesive. It is based upon the amount of force required to pull an adhesive strip from a standard flat surface in a direction parallel to the surface to which it has been affixed with a definite pressure. It is measured in terms of time (in minutes) required to pull a standard area of adhesive coated sheet material from a stainless steel test panel under stress of a constant, standard load.

The tests were conducted on adhesive coated strips applied to a stainless steel panel such that a 12.5 mm by 12.5 mm portion of each strip was in firm contact with the panel with one end portion of the tape being free. The panel with coated strip attached was held in a rack such that the panel forms an angle of 178° with the extended tape free end which is then tensioned by application of a force of one kilogram applied as a hanging weight from the free end of the coated strip. the 2° less than 180° is used to negate any peel forces thus insuring more accurately determine the holding power of the tape being tested. The time elapsed for each tape example to separate from the test panel is recorded as the shear strength.

PSA's useful in the structures of the present invention are known in the art and are compositions which may include one or more of latex crepe, rosin, isobutylene polymers, cumarone resins, acrylic-based copolymers, vinyl ethers, alkyd adhesives, rubber adhesives based on rubbers such as natural rubber, synthetic rubbers, and chlorinated rubbers, polyisobutylene, polyvinyl isopropylene, polybutylacrylate, polyvinyl n-butyl ether, and polyacrylate esters and mixtures thereof. The presently preferred PSA's, because of their extended shelf life and resistance to detackifying under atmospheric conditions, are acrylic-based copolymer adhesives as disclosed in U.S. Pat. No. Re 24,906. One example of such an acrylic-based copolymer is a 95.5:4.5 (measured in parts by weight of each) isooctylacrylate/acrylic acid copolymer. Other preferred adhesives are a 68:26:6 terpolymer of ethyl acrylate, butyl acrylate, and acrylic acid; a 96:4 copolymer of isooctylacrylate and acrylamide; and a 56:40:4 terpolymer of isooctylacrylate, vinylacetate, and acrylic acid. Such acrylic PSA's can be coated on the back side of sheet-like segments of coated abrasive out of a solution of heptane: isopropanol solvent and the heptane: isopropanol solvent subsequently evaporated, leaving a pressure-sensitive adhesive coating.

Abrasive Articles

Abrasive articles of this invention can be a variety of products, such as sheet-like segments, and discs.

The abrasive articles of the invention may comprise an inorganic binding medium, for example, a silicate or ceramic based system, but more preferably comprise an organic binding medium. Preferred organic binding mediums include cured versions of phenolic resins, aminoplast resins, urea-formaldehyde resins, urethane resins, epoxy resins, polyesters, and varnishes. The phenolic resins of the phenol-aldehyde type are preferred. The monomers currently used in greatest volume to produce phenolic resins are phenol and formaldehyde. Other important phenolic starting materials are the alkyl-substituted phenols, including cresols, xylenols, p-tert-butyl-phenol, p-phenylphenol, and nonylphenol. Diphenols, for example, resorcinol (1,3-benzene diol) and bisphenol-A, are employed in smaller quantities for applications requiring special properties.

The phenolic resins suitable as binding mediums when cured may optionally contain plasticizers, crosslinking aids, reactive diluents, (such as those disclosed in assignee's copending application Ser. No. 07/823,998 now abandoned, entitled "Coatable, Thermally Curable Binder Precursor Solutions Modified With a Reactive Diluent, Abrasive Articles Incorporating Same, and Methods of Making Said Abrasive Articles", filed Jan. 22, 1992, and incorporated by reference herein), or other modifiers.

Substrates or backings useful in the present invention include flexible backings upon which an abrasive coating comprising abrasive particles and the binding medium are attached. The substrate can be selected from paper, cloth, film, vulcanized fiber, and the like or a combination of one or more of these materials, or treated versions thereof. The preferred backing or substrate is a flexible polyester film that has had a primer applied between the polyester film and binding medium, such as ethylene/acrylic acid copolymer primer. If a PSA is to be applied to the backside of the polyester film, between the backside of the polyester film and the PSA is preferably applied an aziridine-containing compound such as those disclosed in col. 4 of U.S. Pat. No. 4,749,617 (Canty), and incorporated by reference herein. Alternatively, the substrate may be a nonwoven comprising a lofty, open, fibrous mat of fibers where the fibers can comprise various polymers, including polyamides, polyesters, polypropylene, polyethylene, and various copolymers. Naturally occurring fibers such as cotton, wool, bast fibers and various animal hairs may also be suitable.

In abrasive articles generally, including those of the invention, fillers are frequently used to reduce cost and improve dimensionally stability and other physical characteristics. Fillers can be selected from any filler material that does not adversely affect the characteristics of the cured binding medium. Preferred fillers include calcium carbonate, calcium oxide, calcium metasilicate, aluminum sulfate, alumina trihydrate, cryolite, magnesium, kaolin, quartz, and glass. Fillers can be used in varying amounts limited only by the proviso that the abrasive article retains acceptable mechanical properties (such as flexibility and toughness).

The abrasive particles can be of any conventional grade utilized in the formation of abrasive articles, and can be, for example, flint, garnet, aluminum oxide, ceramic aluminum oxide, alumina zirconia (including fused alumina zirconia such as disclosed in U.S. Pat. Nos. 3,781,172; 3,891,408; and 3,893,826, commercially available from the Norton Company of Worcester, Mass., under the trade designation "NorZon"), diamond, silicon carbide (including refractory coated silicon carbide such as disclosed in U.S. Pat. No. 4,505,720), alpha alumina-based ceramic material (available from Minnesota Mining and Manufacturing Company under the trade designation "Cubitron") as disclosed in U.S. Pat. Nos. 4,314,827; 4,518,397; 4,574,003; and 4,744,802 or mixtures thereof. The abrasive particles can be individual abrasive grains or agglomerated abrasive grains. The frequency concentration of the abrasive particles on the backing or substrate is also conventional. The abrasive particles can be oriented or can be applied to the backing without orientation, depending upon the requirements of the particular abrasive article. The average diameter of the abrasive particles typically ranges from about 3 to about 1000 micrometers, more preferably from about 3 to about 100 micrometers. The crosslinked siloxane coatings utilized in the present invention are especially useful in the lower average particle diameter abrasives such as 3–15 micrometers. Non-abrasive or less abrasive diluent grains may be incorporated, as disclosed in assignee's U.S. Pat. No. 5,011,512, incorporated by reference herein.

In the case of discs and sheets of coated abrasive articles, coated abrasive articles of this invention can be packaged in a manner such that the crosslinked siloxane coating of a first coated abrasive article is in direct contact with a PSA coating of a second article. In the case of a continuous roll of coated abrasive, the crosslinked siloxane coating of a first portion of the roll is in direct contact with the PSA corresponding to the next portion of the roll. Aging studies have shown that adhesion strength of an acrylate adhesive to abrasive particles increased with time so as to cause adhesive transfer to the abrasive particles when unwinding the roll for use. In analyzing this problem, it became apparent that initial and aged peel strength of the PSA, surface release properties of the mineral top size surface, and PSA internal cohesive strength were all important performance considerations. For example, a lower peel strength PSA can strip cleanly off a surface if its internal cohesive strength prevents splitting and transfer of adhesive to the surface at that "peel" value. The reasoning indicates that a higher "shear" (internal cohesion strength) PSA will strip off cleanly from a higher peel surface as long as its "splitting threshold" is higher than the aged peel value. Further, initial peel strength values may be important to the user. PSA's having lower initial adhesion, and which increase in adhesion as a function of dwell time less than other PSAs (other parameters equal) will give less adhesive transfer on a packaged roll which is "aging" while waiting use.

Articles in accordance with the invention may be formed from a plurality of abrasive articles such as sheet-like segments of pressure sensitive adhesive-backed coated abrasive. In articles in accordance with the invention, sheet-like segments preferably of pressure sensitive adhesive-backed coated abrasive can be removed such as by pulling a first segment of pressure sensitive adhesive-backed coated abrasive having its abrasive front surface temporarily adhered to the pressure sensitive adhesive-coated backside of an adjacent pressure sensitive adhesive-backed coated abrasive in such a manner that they will separate. In such articles, the abrasive front surface of each of the plurality of sheet-like segments preferably includes a coating comprising a crosslinked siloxane, the crosslinked siloxane comprising the condensation reaction product of polymers within the Formula I, above. Compatible polymers such as those within Formula II above may also be substituted for a portion of the polymers denoted in Formula I in articles of the invention.

Referring now to FIG. 1, illustrated is an enlarged cross-sectional view of one preferred abrasive article embodiment in accordance with the invention. Coated abrasive 10 includes a flexible backing 12 such as a polyester film onto which is coated a make coating 20 proximal to the backing. Embedded in make coating 20 are a plurality of abrasive particles 14 such as silicon carbide or aluminum oxide abrasive particles. Over the abrasive particles is coated a size coating 22 distal from the backing, and a crosslinked siloxane supersize coating 16 is in turn coated over the size coating. A layer 18 of PSA is coated onto the side opposite of the crosslinked siloxane supersize coating 16. Layer 18 must have sufficient adhesive strength to secure the coated abrasive to a backup pad during use. For example, a typical coated abrasive disc/backup pad may spin at a rate as high as 14,000 revolutions per minute in actual operation.

Figure 2:
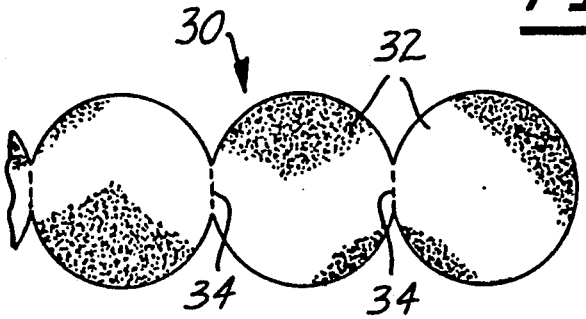
FIG. 2 is a plan view (reduced) of a portion of a concatenate of abrasive discs capable of forming a roll in accordance with this invention and including a crosslinked siloxane size or supersize coating.

FIG. 2 shows a plan view (reduced) of a preferred article of the invention, a concatenation 30 of edge-connected coated abrasive discs 32 capable of being convolutely wound to form a roll which can be easily unrolled. Obviously, other shapes of coated abrasive can be used. A concatenation of coated abrasive discs is more fully described in assignee's U.S. Pat. No. 3,849,949, incorporated herein by reference. Each disc 32 preferably has a structure as shown in cross-section in FIG. 1 and is joined to at least one other similarly constructed disc 32 along a straight edge of the disc 34 formed by removal of a small segment defined by a chord having a length less than ½ the radius of the disc. Straight edge 34 is preferably perforated for easy separation of the discs along the chord. This concatenation 30 of coated abrasive discs, when wound into a roll, has the crosslinked siloxane size or supersize coating of one disc 32 in direct, releasable contact with the PSA on the back side of another disc 32 when the concatenation is convolutely wound. There is no release liner required with packaged coated abrasives of this type. The discs can be easily separated from one another when desired.

Figure 3:
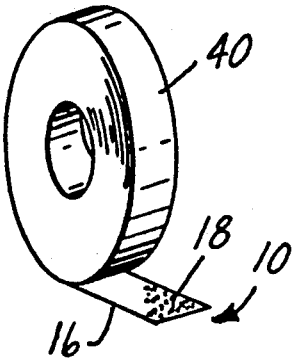
FIG. 3 is a perspective view (greatly reduced) of a roll of coated abrasive material of this invention which includes a crosslinked siloxane size or supersize coating.

FIG. 3 shows a reduced perspective view of another preferred article of the invention, a packaged roll 40 of coated abrasive employing a crosslinked siloxane size or supersize coating. Roll 40 comprises an elongated sheet of coated abrasive material of the type shown in cross-section in either FIGS. 1 or 4. The materials of construction suitable for roll 40 can be the same as those used in aforementioned coated abrasive article 10 In FIG. 3, it can be seen that when the coated abrasive material is wound into a roll, the crosslinked siloxane size or supersize coating 16 will be in direct, releasable contact with a layer of PSA 18. When the user desires to remove a piece of coated abrasive material from roll 40, he or she merely unwinds a portion of roll 40 and cuts or tears this portion from the roll. The crosslinked siloxane coating functions as a release coating, substantially reduces the transfer of PSA to the abrasive particles, reduces the force acquired to unwind the roll, and reduces loading of the abrasive article.

Figure 4:
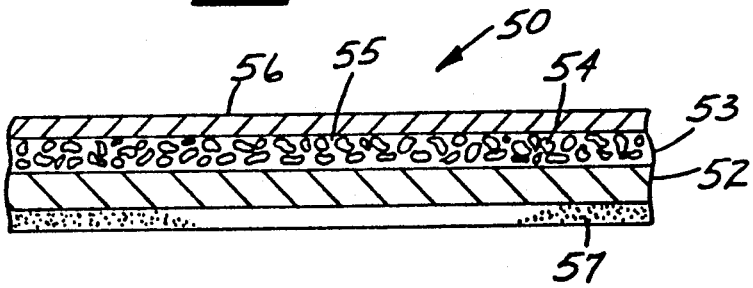
FIG. 4 is a cross-sectional view (enlarged) of another embodiment of a coated abrasive article of this invention including a size coating of crosslinked siloxane.

FIG. 4 shows an enlarged cross-section of another embodiment of a coated abrasive in accordance with the invention. The coated abrasive 50 comprises a backing or substrate 52 having an abrasive coating 53 bonded to the backing. Abrasive coating 53 comprises a plurality of abrasive particles 54 dispersed in a binding medium 55. In this embodiment the abrasive coating is formed from an abrasive slurry. Over the abrasive coating 53 is coated a crosslinked siloxane coating 56. Opposite the side of the abrasive coating 53 is a PSA coating 57.

Methods of Making Abrasive Articles

Methods of making the above-referenced coated abrasive articles having reduced propensity for loading including a crosslinked siloxane size or supersize coating are another aspect of the invention. In one broad embodiment the method comprises applying a coatable slurry to a front side of a substrate or backing, the slurry comprising a plurality of abrasive particles dispersed in a binder precursor solution, subjecting the slurry coated backing to conditions which cure the binder precursor solution, applying a siloxane composition over at least a portion of the abrasive coating, the siloxane composition curing to a crosslinked siloxane coating upon exposure to moisture. Optionally, a pressure sensitive adhesive is applied to the backside of the backing. The composition and thickness of the crosslinked siloxane coating are sufficient to substantially reduce adhesive transfer, the crosslinked siloxane coating comprising the condensation reaction products of components (a), (b), and (c) as described above. Another method includes providing a crosslinked siloxane coating (as above described) on at least the surface of an abrasive article between the particles of abrasive material.

There are a variety of methods to achieve the crosslinked siloxane coating thickness as preferred in this invention. One method is to make a very dilute, acidic solution of components (a), (b), and (c) in a solvent, such as anhydrous isopropyl alcohol or equivalent, depending upon the particular chemistry of components (a), (b), and (c). The percent solids (i.e., the portion remaining on the substrate after solvent evaporation) of the crosslinked siloxane coating will typically be less than about 20%, preferably less than about 10% solids and most preferably less than about 5% solids. The components (a) and (b) when in solution form, can then applied with a very low coating weight over the abrasive coating. In this class of methods components (a), (b), and (c) can be applied by a flow bar-meter roll process, a brush, a roll coater, a die coater, or a curtain coater. The solvent is driven off by heating, and moisture from the environment allows the condensation reaction to proceed to leave behind the crosslinked siloxane coating.

In two roll coating (denoted in the Examples as "2RC"), a web of coated abrasive is passed between one steel roll and one rubber roll, where the rubber roll applies the polymer solution to the web. The solution of components (a), (b), and (c) is typically in a pan, the liquid level of which is above a point necessary to wet the rubber roll with the polymer solution. Again, moisture from the environment allows the crosslinking to proceed.

In flow bar-meter roll coating (denoted "FBC" herein), the coated abrasive web passes between a wrap roll and a flow bar. The polymer solution is fed through a solution pump to the flow bar, which applies the solution to the web. Excess solution drips off of the web as the web travels around the wrap roll approximately 180°, during which the web passes through the space between the wrap roll and a metering roll. The metering roll can be used to adjust the thickness of the coating, while moisture allows the crosslinking to proceed. Any of the rolls may be heated, or, alternatively, the coated web may pass by or through a heated space such as a space heated by infrared lamps. The temperature of the heated space should not exceed 150° C., if used.

In a second class of methods, the crosslinked siloxane and crosslinked polydimethyl silicone coatings can be applied via an electrospray process. A suitable electrospray coating process is described in U.S. Pat. No. 4,748,043, incorporated herein by reference, and the method is denoted "ESC" herein.

As noted above, typically a reactive diluent, such as tetramethoxysilane, is used in the electrospray process to render the polymer solution sprayable.

A method of abrading a workpiece using an abrasive article is also presented, the method including creating relative movement between the abrasive surface of an abrasive article and a workpiece while the workpiece and abrasive surface are touching. The method uses an abrasive article as above described in accordance with the invention, having a crosslinked siloxane coating applied over at least a portion of the surface of the article between the particles of abrasive, the crosslinked siloxane coating composition and thickness sufficient to substantially reduce adhesive transfer and having the composition described herein above. The method preferably includes the use of a backup pad to which the abrasive article is adhered by a pressure sensitive adhesive layer on at least a portion of the backing so that the abrasive article may be attached to a tool, such as a rotary sander or belt sander.

The invention will be further described with reference to the following test methods and examples, wherein all parts and percentages are by weight unless otherwise stated.

TEST METHODS

180° Peel Adhesion

The procedure used to measure the force necessary to remove (i.e. peel) a PSA-coated substrate from a test substrate when the PSA-coated substrate is peeled from the test substrate is termed a "peel adhesion" test. The procedure used in the Examples which follow is now described:

a. Test Substrate=Glass Surface

To illustrate that peel adhesion force required to remove a PSA-coated substrate from a test substrate increases with dwell time of the PSA on the test substrate (such as, for example, when a roll of masking tape is not used for a long time between uses), a standard glass plate (10.2 cm×30.5 cm) was cleaned using one wash of diacetone alcohol followed by three washes of n-heptane. With very light tension, a sample of coated abrasive (2.5 cm×40 cm) having a PSA-backsize coating was then applied along the center of the standard glass plate, PSA side down. The sample was then rolled once with a 2.04 Kg hand roller. The standard glass plate was then secured to a horizontal platen in a standard peel adhesion tester known under the trade name "IMASS." One end of the sample was then attached to a hook which was a part of the peel adhesion tester. The sample was peeled from the standard glass plate at a 180° angle (i.e., one end of the sample was pulled toward the other end) by moving the platen horizontally at a speed of 228.6 cm/min (90 in/min), and the force required recorded, in gm/cm of sample width, for various dwell times.

b. Test Substrate=Coated Abrasive

The test procedures described in "a" above were used to compare peel adhesion results of coated abrasives having various thicknesses of crosslinked siloxane as a supersize coating. The test substrates, instead of glass, were as follows (prior to application of supersize coating):

Substrate 30=30 micrometer,
Substrate 15=15 micrometer, and
Substrate 9=9 micrometer average abrasive grain size coated abrasives, each known under the trade designation "Imperial", available from Minnesota Mining and Manufacturing Company, St. Paul, Minn.

PSAs Used in Peel Adhesion Tests

The following PSAs were variously used in the Examples:

APSA=56 parts isooctyl acrylate, 40 parts vinylacetate, and 4 parts acrylic acid, coated out of a 30:70 solvent mixture of toluene: n-ethyl acetate solvent;

BPSA=95.5 parts isooctyl acrylate and 4.5 parts acrylic acid coated out of a 1:1 mixture of heptane:isopropanol solvent.

Readhesion Test

In this test, a test tape was fabricated using APSA applied to one side of a polyester film having thickness of 0.005 cm. The APSA side of the test tape was applied to Substrate 30, abrasive side, the test tape removed from the abrasive side of Substrate 30, then the APSA coated side "re-applied" to a standard glass surface prepared as explained in "Test Substrate=Glass Surface" above. The 180° peel was then tested, also as described above, to determine the "180° peel readhesion" value for the Substrate 30 having various thicknesses of crosslinked siloxane coating applied thereto.

Abrasion Test To Determine Loading Resistance

Coated abrasive samples to be tested were cut into 10.2 cm diameter discs, secured to a foam backup pad with a PSA, and attached to a standardized abrasive test machine, known under the trade designation "Schiefer". For each coated abrasive tested a test workpiece (a cellulose acetate butyrate donut filled with 25 wt. % $TiO_2$) was weighed before and after the test to determine the weight loss in grams of the workpiece. The test was performed by attaching the test coated abrasive to a platen, while the workpiece was attached to a stationary platen which was forced against the rotating test coated abrasive by a force measured in kilograms of 4.54 kg while rotating in a plane parallel to the test coated abrasive. A test was completed after 500 rotation cycles. The grams of workpiece removed per 500 cycles measured the abrasion performance of the test coated abrasive. The degree of loading is inversely proportional to the abrasion performance, all other parameters being the same.

EXAMPLES

Examples 1-7: Peel Adhesion vs. PSA Dwell Time

Figure 5:
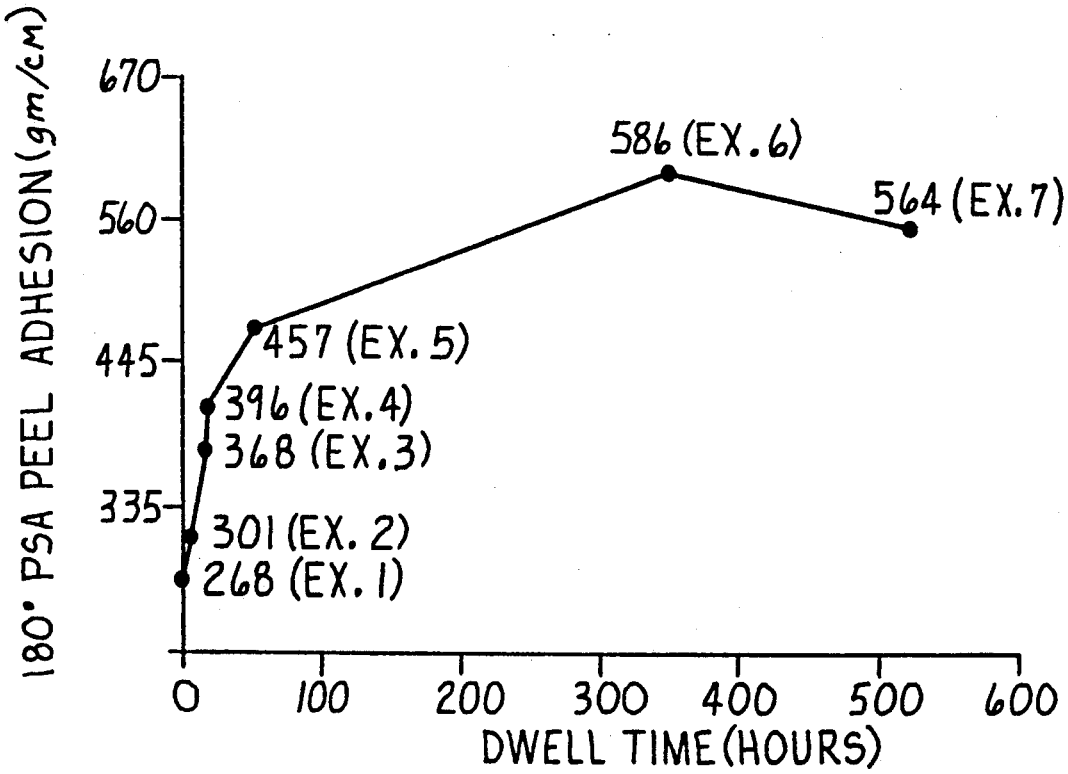
FIG. 5 shows graphically results of 180° PSA peel adhesion tests as a function of dwell time for a PSA adhered to a standard glass surface.
Figure 6:
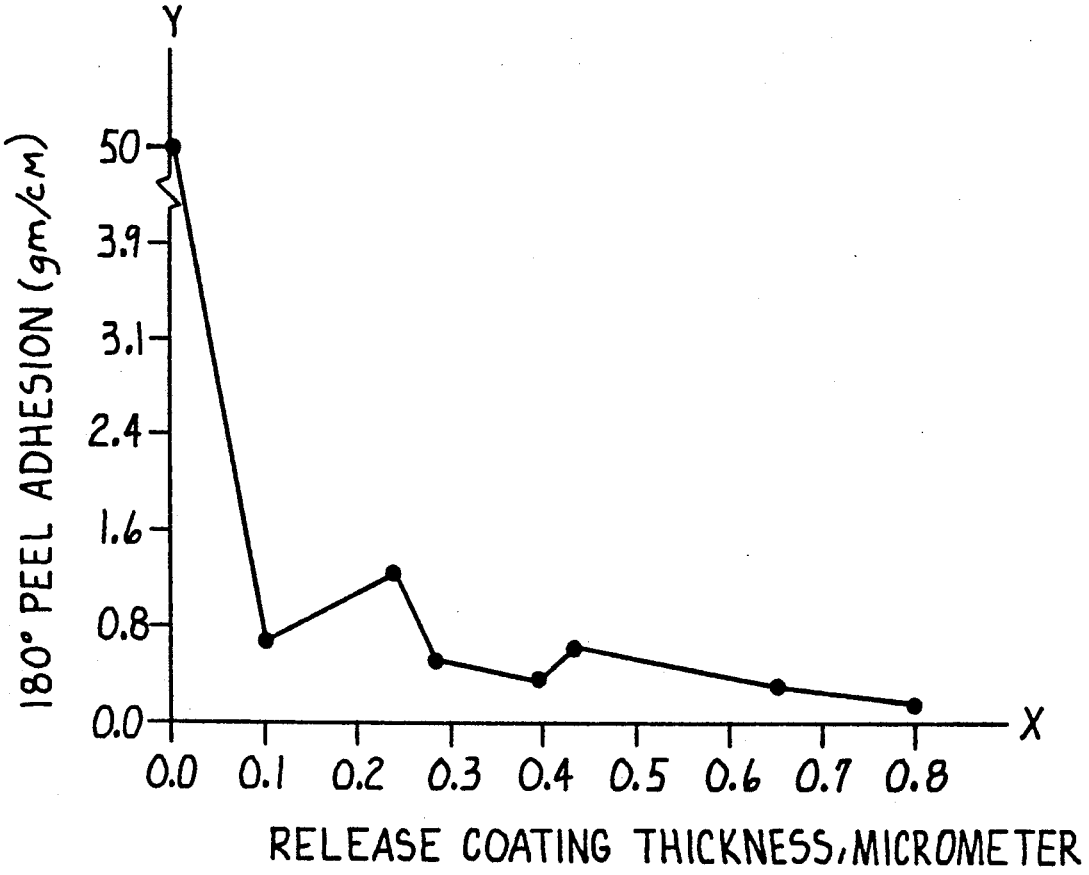
FIG. 6 shows graphically results of 180° PSA peel adhesion tests as a function of thickness of crosslinked siloxane coating on a series of coated abrasives.

To demonstrate that 180° peel adhesion values increase with PSA dwell time on a test substrate, seven coated abrasive strips having dimensions 2.54×40 cm were coated a backsize coating of APSA. Using the test described above as "180° Peel Adhesion, Test Substrate=Glass Surface," the 180° peel adhesion was tested. As can be seen in FIG. 5, peel adhesion increased abruptly with APSA dwell time, then stabilized after about 400 hours at a value much greater than the initial 180° peel value.

Comparative Examples A-C (No Release Coating) and Examples 8-10

This set of examples showed that for coated abrasives using no release coating, 180° peel adhesion values increased as the average abrasive grain size decreased, and that the addition of a coating of crosslinked siloxane significantly reduced 180° peel adhesion. Three controls were made: A=Substrate 30, B=Substrate 15, and C=Substrate 9, each having no coating of crosslinked siloxane. Examples 8-10 utilized the crosslinked siloxane denoted in Table 2 as supersize coating. Table 3 lists the ingredients used in Table 2. For each of the siloxane mixtures of Example 8-10 in Table 2, precursor solutions were prepared by diluting each of the siloxane mixtures 8-10 to 10% solids with anhydrous isopropyl alcohol. The precursor solutions of Examples 8-10 were coated onto Substrates 30, 15, and 9, respectively, with a 2 roll laboratory hand roll coater. After coating, the coated abrasives of Examples 8-10 were placed in an oven at 120° C. for 10 minutes to form a crosslinked siloxane coating having a thickness of about 0.45 micrometer.

After cooling, each coated abrasive of Examples A-C and 8-10 were tested according to the procedure denoted above as "b. Test Substrate=Coated Abrasive".

A backsize coating of BPSA was applied to one side of 6 polyester films (0.005 cm thickness film) for use as test tape. The results are shown in Table 4. The decrease in 180° peel adhesion is dramatic for Examples 8-10.

TABLE 2

| Example | Coating Ingredient Ratios (Parts) |
|---|---|
| 8 | a/b/e = 85/15/7 |
| 9 | a/b/e = 85/15/7 |
| 10 | a/b/e = 85/15/7 |

TABLE 3

| Ingredient | Description | Structure |
|---|---|---|
| a | Diaminopolydimethylsiloxane end capped with isocyanatopropyl triethoxy-silane | $(EtO)_3Si(CH_2)_3-\overset{HOH}{\overset{\vert\vert\vert}{NCN}}-\left[\begin{matrix}M\\ \vert\\ SiO\\ \vert\\ M\end{matrix}\right]_{5K}-\overset{HOH}{\overset{\vert\vert\vert}{NCN}}-(CH_2)_3-Si-(OEt)_3$ Et = ethyl; M = methyl; 5K = 5000 |
| b | monoaminopolydimethylsiloxane end capped with isocyanatopropyl triethoxysilane | $Bu\left[SiO\right]_{15K}\overset{HOH}{\overset{\vert\vert\vert}{NCN}}-(CH_2)_3-Si(OEt)_3$ Bu = butyl; 15K = 15,000 |
| c | tetraethoxysilane (reactive diluent) | $Si-(OEt)_4$ |
| d | diaminopolypropylene oxide end capped with isocyanatopropyl triethyoxy-silane | $(EtO)_3-Si\left[CH_2\right]_3\overset{HOH}{\overset{\vert\vert\vert}{NCN}}-[PPO]_{2K}-\overset{HOH}{\overset{\vert\vert\vert}{NCN}}-(CH_2)_3-Si(OEt)_3$ PPO = polypropylene oxide; 2K = 2,000 |
| e | trichloroacetic acid | $Cl_3COOH$ |

TABLE 4

| Example (gm/cm) | Siloxane Coating Thickness μm | 180° Peel Adhesion (gm/cm) |
|---|---|---|
| A | 0 | 67 |
| B | 0 | 201 |

TABLE 4-continued

| Example (gm/cm) | Siloxane Coating Thickness μm | 180° Peel Adhesion (gm/cm) |
|---|---|---|
| C | 0 | 391 |
| 8 | 0.45 | 0.2 |
| 9 | 0.45 | 0.35 |
| 10 | 0.45 | 0.94 |

Comparative Example D and Examples 11-17 (Varying Thickness of Siloxane and Coating Methods)

This set of examples showed that 180° peel adhesion generally decreased as crosslinked siloxane coating thickness increased, and demonstrated the feasibility of the three coating methods denoted above as ESC, 2RC, and FBC. The ESC samples were cured using infrared lamps, and the coating solutions in 2RC and FBC methods were diluted to 3% solids using isopropyl alcohols. The FBC samples were oven cured at 70° C. for 2+ minutes. The coating thickness (dry) of the crosslinked siloxane, coating methods, siloxane composition, and 180° peel adhesion values are tabulated in Table 5. Of the three coating methods ESC and FBC methods gave more consistent coating thicknesses than 2RC. The test tape for 180° C. peel adhesion was the same as used in Examples 1-7, except that BPSA was used with Test method "b. Test Substrate=Coated Adhesive". Note again from Table 5 that as crosslinked siloxane coating thickness increased, 180° peel adhesion decreased dramatically.

TABLE 5

| Example | Coating Thickness, Micrometer | Coating Method | Coating Ingredient Ratios (parts) | 180° adhesion, gm/cm |
|---|---|---|---|---|
| D | 0 | — | — | 52.4 |
| 11 | 0.100 | ESC | a/b/c/e 70.8/12.5/16.7/7.0 | 0.71 |
| 12 | 0.250 | ESC | a/b/c/e 70.8/12.5/16.7/7.0 | 0.31 |
| 13 | 0.400 | ESC | a/b/c/e 70.8/12.5/16.7/7.0 | 0.47 |
| 14 | 0.218 | 2RC | a/b/e 85/15/7.0 | 1.14 |
| 15 | 0.436 | 2RC | a/b/e 85/15/7.0 | 0.79 |
| 16 | 0.654 | 2RC | a/b/e 85/15/7.0 | 0.43 |
| 17 | 0.800 | FBC | a/b/e 85/15/7.0 | 0.20 |

Comparative Example E and Example 18 (Propylene Oxide-Siloxane)

These examples compared 180° peel adhesion values obtained from non-siloxane coated abrasives with 180° peel adhesion values obtained from a coated abrasive having a propylene oxide-siloxane type of crosslinked siloxane supersize coating. Substrate 30 was used, along with "Test Substrates=Coated Abrasive" test method, described previously. The crosslinked siloxane was coated out of anhydrous isopropyl alcohol solution (5% solids), cured at 100° C. for 10 minutes, and tested the next day for 180° peel adhesion. The results are presented in Table 6.

TABLE 6

| Example | Coating Ingredient Ratios (Parts) | 180° Peel Adhesion, (gm/cm)* |
|---|---|---|
| E | — | 4.45 |
| 18 | a/d/e = 50/50/7 | 0.092 |

*Average of three readings for each Example.

Comparative Examples F-M and Examples 19-22 (Abrasion Performance)

Four Substrate 30 coated abrasives having crosslinked siloxane supersize coatings (Examples 19-22) were compared in their abrading performance with four Substrate 30 coated abrasives having prior art zinc stearate supersize coating (Examples J-M) and with four Substrate 30 coated abrasives having no supersize coating (Examples F-I). The zinc stearate supersize coating used was coated by hand using a laboratory 2 roll coater. The zinc stearate solution was 28% solids solution containing 72.52% water, 2.4% cellulosic binder, 0.62% sulfosuccinate wetting agent, 0.5% hydrocarbon anti-foaming agent, 5% ethylene glycol monoethyl ether, and 19% zinc stearate, and was coated to achieve a coating weight of 0.67 gm/cm$^2$ to 0.75 gm/cm$^2$ after oven drying at 100° C. for 5 minutes. The solution used was the equivalent of that used in control Example A of U.S. Pat. No. 4,988,554, incorporated by reference herein. The method produced by dry coating of zinc stearate having thickness of about 2.0 micrometers.

The crosslinked siloxane coating of Examples 19-22 was the equivalent of that used in Examples 8-10, and was flow-bar coated to achieve 0.8 micrometer dry coating thickness for each of Examples 19-22. The crosslinked siloxane coating could have been coated to higher dry coating weights than 0.8 micrometers.

Comparative abrasion performance data is shown in Table 7. Note that even at coating thickness much less than the zinc stearate coating, the crosslinked siloxane-coated abrasives performed much better than coated abrasives having no supersize coating.

TABLE 7

| Ex. | Cut Rate, (gm/500 cycles) | Ex. | Cut Rate, (gm/500 cycles) | Ex. | Cut Rate, (gm/500 cycles) |
|---|---|---|---|---|---|
| F | 0.192 | J | 0.839 | 19 | 0.327 |
| G | 0.156 | K | 0.946 | 20 | 0.384 |
| H | 0.176 | L | 0.820 | 21 | 0.447 |
| I | 0.128 | M | 0.945 | 22 | 0.453 |
| Average | 0.163 | | 0.888 | | 0.403 |
| STD. DEV. | 0.028 | | 0.067 | | 0.059 |

Comparative Examples N and O and Examples 23-26 (Readhesion Tests)

Figure 7:
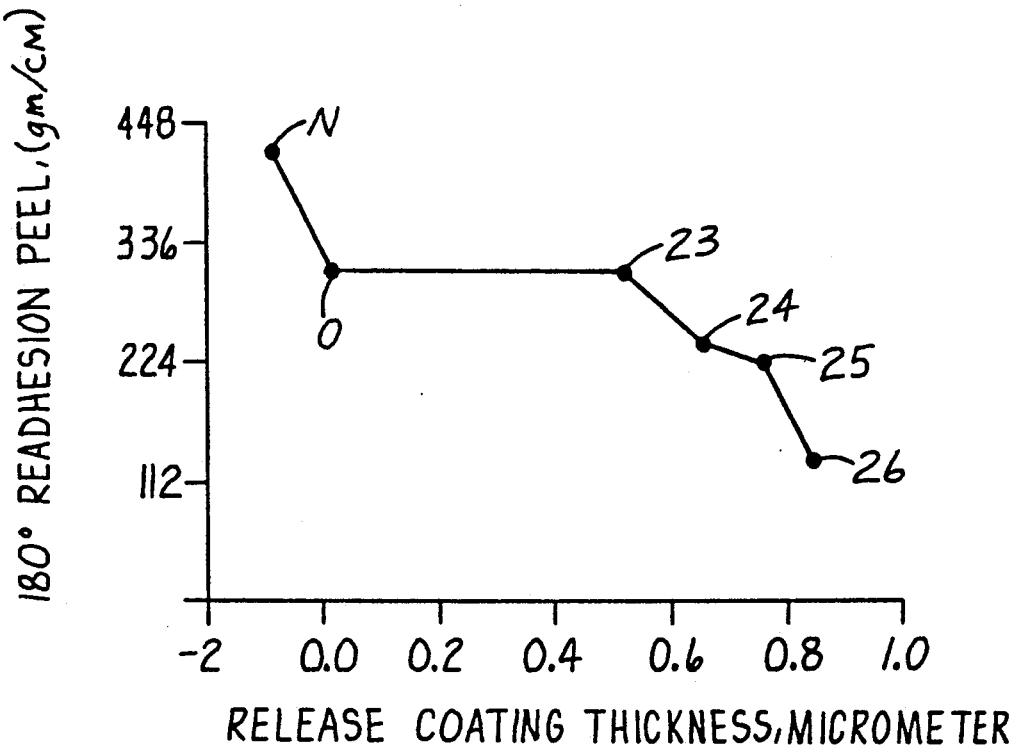
FIG. 7 shows graphically results of 180° PSA peel "readhesion" tests as a function of crosslinked siloxane coating thickness, where in each case a PSA coated test tape was first applied to a crosslinked siloxane-coated abrasive and then reapplied to a standard glass surface to test readhesion of the test tape.

In this set of tests, the results of which are shown in FIG. 7, "readhesion" tests were performed using different thicknesses of crosslinked siloxane coating. Table 8 shows the thickness of the crosslinked siloxane coating for each example. The test described above as "readhesion test" was used to evaluate readhesion properties of coated abrasives having various thicknesses of crosslinked siloxane as a size or supersize coating. In Examples 23-26 the crosslinked siloxane used was that used in Examples 8-10 above, while the substrate coated abrasive used was Substrate 30, also as described above.

TABLE 8

| Example | Crosslinked Siloxane Thickness (micrometer) |
|---|---|
| N | 0 |
| O | 0 |
| 23 | 0.42 |
| 24 | 0.60 |
| 25 | 0.65 |

TABLE 8-continued

| Example | Crosslinked Siloxane Thickness (micrometer) |
|---|---|
| 26 | 0.80 |

FIG. 7 show the results of the readhesion testing. The readhesion value obtained for Example N was obtained for a test tape peeled off glass only without readhesion. Comparative Example O shows the 180° readhesion value for the test tape initially applied to Substrate 30, removed from the substrate, and the tape reapplied to a glass surface. Note that the readhesion peel value for Example O drops to about 320 gm/cm from the value of about 410 gm/cm for Example N. The value for Example O is the "control" value for reference. Note that the readhesion value for Example 24 (0.6 micrometer thickness of crosslinked siloxane coating) of about 270 gm/cm is about 15% lower than the control value. This is a typical range expected for reduction in readhesion peel value for a silicone treated release liner. Above about 0.4 micrometer crosslinked siloxane coating thickness, the readhesion peel strength values decrease indicating that the siloxane is transferring to the PSA and reducing the readhesion peel value. Thus, the best thickness range for a release coating of the crosslinked siloxane ranges from about 0.1 to about 0.6 micrometer so as to give no more than the equivalent silane silicone transfer found in commercial silicone release liners.

Various modifications and alterations of this invention will become apparent to those skilled in the art without departing from the scope and spirit of this invention, and it should be understood that this invention is not to be unduly limited to the illustrative embodiments set forth herein.

What is claimed is:

1. An abrasive article comprising a substrate having on a surface thereof particles of an abrasive material secured by a binding medium to form an abrasive surface wherein at least a portion of the abrasive surface has thereon a coating comprising a crosslinked siloxane, the crosslinked siloxane comprising the condensation reaction product of (a) about 1 to about 100 percent by weight of polymer selected from the group consisting of polymers of the general formula:

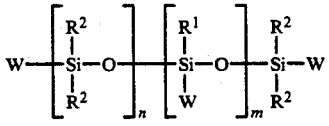

(I)

and mixtures thereof:

wherein n and m each represent integers, wherein the sum of n plus m is an integer of about 20 to about 5000;

m has a value ranging from about 0 to about 0.1(n+m);

n is an integer of about 20 to about 5000;

$R^1$ are monovalent moieties which can be the same or different selected from the group consisting of alkyl, substituted alkyl, aryl, and substituted aryl;

$R^2$ are monovalent moieties which can be the same or different selected from the group consisting of alkyl, substituted alkyl, aryl, and substituted aryl;

W are monovalent moieties which can be the same or different selected from the group consisting of alkyl, substituted alkyl, aryl, substituted aryl, and reactive hydrolyzable group

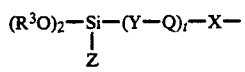

wherein at least about 50% of the total number of silicon atoms excluding those in said reactive hydrolyzable group(s) have two methyl groups bonded thereto, and wherein at least one reactive hydrolyzable group

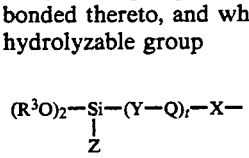

appears on the polymer of Formula I and further wherein at least about 25% of the polymers of Formula I in the coating have at least two reactive hydrolyzable groups

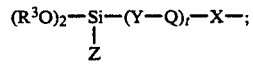

wherein

X are divalent linking groups which can be the same or different selected from the group consisting of alkylene groups comprising about 1 to about 12 carbon atoms;

Q are divalent linking groups which can be the same or different selected from the group consisting of urea, amide, urethane, thiourethane, ether and thioether groups;

Y are divalent linking groups which can be the same or different selected from the group consisting of alkylene groups comprising about 1 to about 12 carbon atoms;

t is an integer of 0 to 10;

Z are monovalent moieties which can be the same or different selected from the group consisting of —OR and —R where R is an alkyl group comprising about 1 to about 3 carbon atoms; and $R^3$ is a monovalent alkyl group comprising about 1 to about 3 carbon atoms;

(b) about 0 to about 99% by weight of a component selected from the group consisting of compounds and polymers of the general Formula II:

$$(R^3O)_3—Si—A \qquad (II)$$

hydrolysates thereof, and mixtures thereof wherein $R^3$ is defined as above;

A is a monovalent moiety selected from the group consisting of $—OR^3$, a monovalent alkyl group comprising about 1 to about 20 carbon atoms, and $—X—(Q)_p—[D—Q]_r—(Y)_b—Si(OR^3)_3$ wherein X, Q, t, Y and $R^3$ are defined as above;

D is a divalent group which can be the same or different selected from the group consisting of alkylene group comprising from 2 to about 30 carbon atoms, aralkylene groups comprising from about 6 to about 30 carbon atoms, arylene groups comprising from 6 to about 30 carbon atoms, divalent polymeric segments having a number average molecular weight of 500 to about 10,000 selected from the group consisting of polyether, polyolefin, polyester, polydiene, and mixtures thereof;

p is an integer from 0 to 1; and b is an integer from 0 to 1;

wherein when t is an integer of 1 to 10, b must equal 1 and p must equal 1; and when t=0 and b=0, p must also equal 0;

wherein the weight percentages of (a) and (b) are based upon the total weight of (a) plus (b); and (c) about 1 to about 15% by weight based upon the total weight of (a) plus (b) of a component selected from the group consisting of acids having pKas of less than about 3, anhydrides of acids having pKas of less than about 3, ammonium and lower alkyl ammonium salts of acids having pKas of less than about 3, and mixtures thereof.

2. An abrasive article in accordance with claim 1 wherein the binding medium comprises an organic binding medium.

3. An abrasive article in accordance with claim 1 wherein the binding medium comprises a first layer proximal to the substrate and a layer distal to the substrate and wherein the crosslinked siloxane is present in the distal layer.

4. An abrasive article in accordance with claim 1 wherein said crosslinked siloxane is selected from the group consisting of Formula I wherein $R^1$ and $R^2$ each comprise methyl, X and Y each comprise $—CH_2CH_2CH_2—$, t=1, and Q is selected from the group consisting of urea and thioether groups.

5. An abrasive article in accordance with claim 1 wherein the sum of n plus m is an integer ranging from about 70 to 1000.

6. An abrasive article in accordance with claim 1 wherein the sum of n plus m is an integer ranging from about 70 to 500.

7. An abrasive article in accordance with claim 1 wherein m ranges from about 0 to about 100.

8. An abrasive article in accordance with claim 1 wherein the coating comprises from about 5 to about 30 percent by weight of polymer I, based on total weight of (a) plus (b).

9. An abrasive article in accordance with claim 1 wherein the coating comprises from about 50 to about 90 percent by weight of polymer I, based on total weight of (a) plus (b).

10. An abrasive article in accordance with claim 1 wherein at least 40% of the polymers of Formula I in the coating have at least two reactive hydrolyzable groups $$(R^3O)_2—\underset{\underset{Z}{|}}{Si}—(Y—Q)_t—X—.$$

11. An abrasive article in accordance with claim 1 wherein the coating comprises up to about 50 percent by weight of component (b), based on total weight of (a) plus (b).

12. An abrasive article in accordance with claim 1 wherein component (b) comprises compounds selected from the group consisting of alkoxysilyl terminated alkanes, alkoxysilyl terminated ethers, alkoxysilyl terminated thioethers, tetralkoxysilyl compounds, trialkoxysilyl terminated polypropylene oxide, trialkoxysilyl terminated polyethylene oxide, trialkoxysilyl terminated polytetramethylene oxide, trialkoxysilyl terminated polycaprolactone, and mixtures thereof.

13. An abrasive article in accordance with claim 1 wherein component (c) is a composition comprising compounds selected from the group consisting of trichloroacetic acid, cyanoacetic acid, malonic acid, nitroacetic acid, dichloroacetic acid, difluoroacetic acid, trichloroacetic anhydride, dichloroacetic anhydride, difluoroacetic anhydride, triethylammonium trichloroacetate, trimethylammonium trichloroacetate, and mixtures thereof.

14. An article from which sheet-like segments of pressure-sensitive adhesive-backed coated abrasive can be removed, each segment having an abrasive front surface, said article comprising a plurality of sheet-like segments of pressure-sensitive adhesive-backed coated abrasive, wherein a first segment of pressure-sensitive adhesive-backed coated abrasive has its abrasive front surface temporarily adhered to the pressure-sensitive adhesive-coated backside of an adjacent pressure sensitive adhesive-backed coated abrasive, wherein said abrasive front surface of each of said plurality of sheet-like segments includes a coating comprising a crosslinked siloxane, the crosslinked siloxane comprising the condensation reaction product of (a) about 1 to about 100 percent by weight of polymer selected from the group consisting of polymers of the general formula:

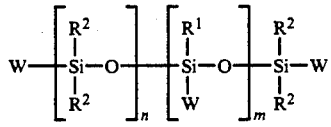

(I)

and mixtures thereof:

wherein n and m each represent integers, wherein the sum of n plus m is an integer of about 20 to about 5000;

m has a value ranging from about 0 to about 0.1(n+m);

n is an integer of about 20 to about 5000;

$R^1$ are monovalent moieties which can be the same or different selected from the group consisting of alkyl, substituted alkyl, aryl, and substituted aryl;

$R^2$ are monovalent moieties which can be the same or different selected from the group consisting of alkyl, substituted alkyl, aryl, and substituted aryl;

W are monovalent moieties which can be the same or different selected from the group consisting of alkyl, substituted alkyl, aryl, substituted aryl, and reactive hydrolyzable group $$(R^3O)_2—\underset{\underset{Z}{|}}{Si}—(Y—Q)_t—X—$$

wherein at least about 50% of the total number of silicon atoms excluding those in said reactive hydrolyzable group(s) have two methyl groups bonded thereto, and wherein at least one reactive hydrolyzable group $$(R^3O)_2—\underset{\underset{Z}{|}}{Si}—(Y—Q)_t—X—$$

appears on the polymer of Formula I and further wherein at least about 25% of the polymers of Formula I in the coating have at least two reactive hydrolyzable groups $$(R^3O)_2-\underset{\underset{Z}{|}}{Si}-(Y-Q)_t-X-;$$

wherein

X are divalent linking groups which can be the same or different selected from the group consisting of alkylene groups comprising about 1 to about 12 carbon atoms;

Q are divalent linking groups which can be the same or different selected from the group consisting of urea, amide, urethane, thiourethane, ether and thioether groups;

Y are divalent linking groups which can be the same or different selected from the group consisting of alkylene groups comprising about 1 to about 12 carbon atoms;

t is an integer of 0 to 10;

Z are monovalent moieties which can be the same or different selected from the group consisting of —OR and —R wherein R is an alkyl group comprising about 1 to about 3 carbon atoms; and $R^3$ is a monovalent alkyl group comprising about 1 to about 3 carbon atoms;

(b) about 0 to about 99% by weight of a component selected from the group consisting of compounds and polymers of the general Formula II:

$$(R^3O)_3-Si-A \qquad (II)$$

hydrolysates thereof, and mixtures thereof wherein $R^3$ is defined as above;

A is a monovalent moiety selected from the group consisting of $-OR^3$, a monovalent alkyl group comprising about 1 to about 20 carbon atoms, and $-X-(Q)_p-[D-Q]_f-(Y)_b-Si(OR^3)_3$ wherein X, Q, t, Y and $R^3$ are defined as above;

D is a divalent group which can be the same or different selected from the group consisting of alkylene group comprising from 2 to about 30 carbon atoms, aralkylene groups comprising from about 6 to about 30 carbon atoms, arylene groups comprising from 6 to about 30 carbon atoms, divalent polymeric segments having a number average molecular weight of 500 to about 10,000 selected from the group consisting of polyether, polyolefin, polyester, polydiene, and mixtures thereof;

p is an integer from 0 to 1; and b is an integer from 0 to 1;

wherein when t is an integer of 1 to 10, b must equal 1 and p must equal 1; and when t=0 and b=0, p must also equal 0;

wherein the weight percentages of (a) and (b) are based upon the total weight of (a) plus (b); and (c) about 1 to about 15% by weight based upon the total weight of (a) plus (b) of a component selected from the group consisting of acids having pKas of less than about 3, anhydrides of acids having pKas of less than about 3, ammonium and lower alkyl ammonium salts of acids having pKas of less than about 3, and mixtures thereof.

15. An article in accordance with claim 14 wherein said sheet-like segments are within a continuous strip of coated abrasive which is wound into a roll.

16. An article in accordance with claim 14 wherein said sheet-like segments are at least partially overlapped to form a stack.

17. An article in accordance with claim 14 wherein each of said sheet-like segments are edged-wise connected to at least one other sheet-like segment by easily severed edge connections, thus enabling the sheet-like segments to be wound into a roll.

18. An article in accordance with claim 14 wherein said crosslinked siloxane and a pressure-sensitive adhesive on said pressure-sensitive adhesive-backed coated abrasives are selected to have an initial 180° peel adhesion ranging from about 0.1 gm/cm to about 10 gm/cm.

19. An article in accordance with claim 18 wherein said pressure-sensitive adhesive comprises compositions selected from the group consisting of latex crepe, rosin, isobutylene polymers, cumarone resins, acrylic-based copolymers, vinyl ethers, alkyl adhesives, rubber adhesives based on natural rubber, synthetic rubber, and chlorinated rubbers, polyisobutylene, polyvinyl isopropylene, polybutylacrylate, polyvinyl n-butyl ether, and polyacrylate esters, and mixtures thereof.

20. An article in accordance with claim 19 wherein said pressure-sensitive adhesive is an acrylic-based copolymer.

21. An article in accordance with claim 20 wherein said acrylic-based copolymer is a copolymer of isooctyl-acrylate and acrylic acid.

22. An article in accordance with claim 14 wherein said coating comprising a crosslinked siloxane has a thickness not greater than about 1.0 micrometer.

23. A method of making an abrasive article, the abrasive article comprising a substrate having on a surface thereof particles of abrasive material secured by a binding medium to form an abrasive surface wherein at least a portion of the abrasive surface has thereon a coating comprising a crosslinked siloxane, wherein the crosslinked siloxane comprises the condensation reaction product of (a) about 1 to about 100 percent by weight of polymer selected from the group consisting of polymers of the general formula:

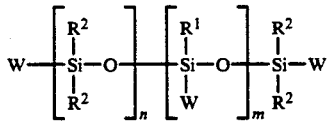

(I)

and mixtures thereof:

wherein n and m each represent integers, wherein the sum of n plus m is an integer of about 20 to about 5000;

m has a value ranging from about 0 to about 0.1(n+m);

n is an integer of about 20 to about 5000;

$R^1$ are monovalent moieties which can be the same or different selected from the group consisting of alkyl, substituted alkyl, aryl, and substituted aryl;

$R^2$ are monovalent moieties which can be the same or different selected from the group consisting of alkyl, substituted alkyl, aryl, and substituted aryl;

W are monovalent moieties which can be the same or different selected from the group consisting of alkyl, substituted alkyl, aryl, substituted aryl, and reactive hydrolyzable group $$(R^3O)_2-\underset{\underset{Z}{|}}{Si}-(Y-Q)_t-X-$$

wherein at least about 50% of the total number of silicon atoms excluding those in said reactive hydrolyzable group(s) have two methyl groups bonded thereto and wherein at least one reactive hydrolyzable group $$(R^3O)_2-\underset{\underset{Z}{|}}{Si}-(Y-Q)_t-X-$$

appears on the polymer of Formula I and further wherein at least about 25% of the polymers of Formula I in the coating have at least two reactive hydrolyzable groups $$(R^3O)_2-\underset{\underset{Z}{|}}{Si}-(Y-Q)_t-X-;$$

wherein

X are divalent linking groups which can be the same or different selected from the group consisting of alkylene groups comprising about 1 to about 12 carbon atoms;

Q are divalent linking groups which can be the same or different selected from the group consisting of urea, amide, urethane, thiourethane, ether and thioether groups;

Y are divalent linking groups which can be the same or different selected from the group consisting of alkylene groups comprising about 1 to about 12 carbon atoms;

t is an integer of 0 to 10;

Z are monovalent moieties which can be the same or different selected from the group consisting of —OR and —R wherein R is an alkyl group comprising about 1 to about 3 carbon atoms; and $R^3$ is a monovalent alkyl group comprising about 1 to about 3 carbon atoms;

(b) about 0 to about 99% by weight of a component selected from the group consisting of compounds and polymers of the general Formula II:

$$(R^3O)_3-Si-A \qquad (II)$$

hydrolysates thereof, and mixtures thereof wherein $R^3$ is defined as above;

A is a monovalent moiety selected from the group consisting of $-OR^3$, a monovalent alkyl group comprising about 1 to about 20 carbon atoms, and $-X-(Q)_p-[D-Q]_t-(Y)_b-Si(OR^3)_3$ wherein X, Q, t, Y and $R^3$ are defined as above;

D is a divalent group which can be the same or different selected from the group consisting of alkylene group comprising from 2 to about 30 carbon atoms, aralkylene groups comprising from about 6 to about 30 carbon atoms, arylene groups comprising from 6 to about 30 carbon atoms, divalent polymeric segments having a number average molecular weight of 500 to about 10,000 selected from the group consisting of polyether, polyolefin, polyester, polydiene, and mixtures thereof;

p is an integer from 0 to 1; and b is an integer from 0 to 1;

wherein when t is an integer of 1-10, b must equal 1 and p must equal 1; and when t=0 and b=0, p must also equal 0;

wherein the weight percentages of (a) and (b) are based upon the total weight of (a) plus (b); and (c) about 1 to about 15% by weight based upon the total weight of (a) plus (b) of a component selected from the group consisting of acids having pKas of less than about 3, anhydrides of acids having pKas of less than about 3, ammonium and lower alkyl ammonium salts of acids having pKas of less than about 3, and mixtures thereof, said method comprising applying a coatable slurry to a front side of a backing, the slurry comprising a plurality of abrasive particles dispersed in a binder precursor solution, subjecting the slurry coated backing to conditions which cure the binder precursor solution, applying a siloxane composition over at least a portion of the abrasive coating, the siloxane composition curing to a crosslinked siloxane coating upon exposure to moisture.

24. A method in accordance with claim 23 wherein the crosslinked siloxane is in the form of a coating supplied by a method selected from the group consisting of roll coating, spray coating, gravure coating, electrospray coating, flow bar-meter roll coating, curtain coating, and combinations thereof.

25. A method of abrading a workpiece using an abrasive article, the abrasive article comprising a substrate having on a surface thereof particles of abrasive material secured by a binding medium to form an abrasive surface wherein at least a portion of the abrasive surface has thereon a coating comprising a crosslinked siloxane, the crosslinked siloxane comprising the condensation reaction product of (a) about 1 to about 100 percent by weight of polymer selected from the group consisting of polymers of the general formula:

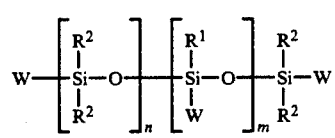

(I)

and mixtures thereof:

wherein n and m each represent integers, wherein the sum of n plus m is an integer of about 20 to about 5000;

m has a value ranging from about 0 to about 0.1(n+m);

n is an integer of about 20 to about 5000;

$R^1$ are monovalent moieties which can be the same or different selected from the group consisting of alkyl, substituted alkyl, aryl, and substituted aryl;

$R^2$ are monovalent moieties which can be the same or different selected from the group consisting of alkyl, substituted alkyl, aryl, and substituted aryl;

W are monovalent moieties which can be the same or different selected from the group consisting of alkyl, substituted alkyl, aryl, substituted aryl, and reactive hydrolyzable group $$(R^3O)_2-\underset{\underset{Z}{|}}{Si}-(Y-Q)_t-X-$$

wherein at least about 50% of the total number of silicon atoms excluding those in said reactive hydrolyzable group(s) have two methyl groups bonded thereto, and wherein at least one reactive hydrolyzable group $$(R^3O)_2-\underset{\underset{Z}{|}}{Si}-(Y-Q)_t-X-$$

appears on the polymer of Formula I and further wherein at least about 25% of the polymers of Formula I in the coating have at least two reactive hydrolyzable groups $$(R^3O)_2-\underset{\underset{Z}{|}}{Si}-(Y-Q)_t-X-;$$

wherein

X are divalent linking groups which can be the same or different selected from the group consisting of alkylene groups comprising about 1 to about 12 carbon atoms;

Q are divalent linking groups which can be the same or different selected from the group consisting of urea, amide, urethane, thiourethane, ether and thioether groups;

Y are divalent linking groups which can be the same or different selected from the group consisting of alkylene groups comprising about 1 to about 12 carbon atoms;

t is an integer of 0 to 10;

Z are monovalent moieties which can be the same or different selected from the group consisting of —OR and —R wherein R is an alkyl group comprising about 1 to about 3 carbon atoms; and $R^3$ is a monovalent alkyl group comprising about 1 to about 3 carbon atoms;

(b) about 0 to about 99% by weight of a component selected from the group consisting of compounds and polymers of the general Formula II:

$$(R^3O)_3-Si-A \qquad (II)$$

hydrolysates thereof, and mixtures thereof wherein $R^3$ is defined as above;

A is a monovalent moiety selected from the group consisting of $-OR^3$, a monovalent alkyl group comprising about 1 to about 20 carbon atoms, and $-X-(Q)_p-[D-Q]_t-(Y)_b-Si(OR^3)_3$ wherein X, Q, t, Y and $R^3$ are defined as above;

D is a divalent group which can be the same or different selected from the group consisting of alkylene group comprising from 2 to about 30 carbon atoms, aralkylene groups comprising from about 6 to about 30 carbon atoms, arylene groups comprising from 6 to about 30 carbon atoms, divalent polymeric segments having a number average molecular weight of 500 to about 10,000 selected from the group consisting of polyether, polyolefin, polyester, polydiene, and mixtures thereof;

p is an integer from 0 to 1; and b is an integer from 0 to 1;

wherein when t is an integer of 1 to 10, b must equal 1 and p must equal 1; and when t=0 and b=0, p must also equal 0;

wherein the weight percentages of (a) and (b) are based upon the total weight of (a) plus (b); and (c) about 1 to about 15% by weight based upon the total weight of (a) plus (b) of a component selected from the group consisting of acids having pKas of less than about 3, anhydrides of acids having pKas of less than about 3, ammonium and lower alkyl ammonium salts of acids having pKas of less than about 3, and mixtures thereof, said method comprising creating relative movement of the abrasive surface and the workpiece while said abrasive surface and said workpiece are forcibly touching.

26. A method in accordance with claim 25 wherein said workpiece comprises materials selected from the group consisting of wood, wood like materials, plastics, fiberglass, soft metal alloys, enamel surfaces, and painted surfaces.

27. An abrasive article including a substrate having on a surface thereof particles of an abrasive material secured by a binding medium to form an abrasive surface, wherein at least a portion of the abrasive surface has thereon a coating comprising crosslinked polydimethylsilicones having from about 5 to about 25 mole percent epoxy cyclohexyl ethyl pendant substituents, the polydimethylsilicones selected from the group consisting of polymers with Formula III

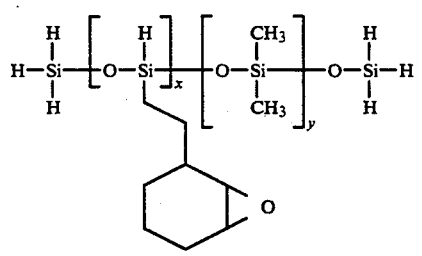

(III)

and mixtures thereof, wherein x ranges from about 6 to about 12 and y ranges from about 55 to about 110, wherein said polymers copolymerize in the presence of from 0.01 to 10.0 weight percent of total weight of (III) of diaryl iodonium hexafluoroantimonate within Formula IV,

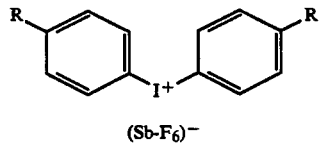

(IV)

wherein R are the same or different selected from the group consisting of alkyls, substituted alkyls, aryls, and substituted aryls having from 1 to 15 carbon atoms, and wherein said abrasive article has on another surface thereof a pressure sensitive adhesive, and said coating comprising crosslinked polydimethyl-silicones has a thickness ranging from about 0.1 to about 1.0 micrometer.

* * * * *

UNITED STATES PATENT AND TRADEMARK OFFICE

CERTIFICATE OF CORRECTION

PATENT NO. : 5,213,589

DATED : May 25, 1993

INVENTOR(S) : Ronning et al.

It is certified that error appears in the above-indentified patent and that said Letters Patent is hereby corrected as shown below:

Col. 13, line 37 "comprises about ; to about 15" should be --comprises about 1 to about 15--

Col. 13, line 36, "The" starts a new paragraph.

Signed and Sealed this

Fifth Day of July, 1994

Bruce Lehman

*Attest:*

BRUCE LEHMAN

*Attesting Officer*

*Commissioner of Patents and Trademarks*